US011505888B2

(12) United States Patent
Kim et al.

(10) Patent No.: US 11,505,888 B2
(45) Date of Patent: Nov. 22, 2022

(54) CLOTHING TREATMENT DEVICE AND METHOD FOR CONTROLLING SAME

(71) Applicant: LG Electronics Inc., Seoul (KR)

(72) Inventors: Keunjoo Kim, Seoul (KR); Jaeyong Jeong, Seoul (KR); Aekyung Chae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 102 days.

(21) Appl. No.: 16/611,096

(22) PCT Filed: Jul. 4, 2018

(86) PCT No.: PCT/KR2018/007565
§ 371 (c)(1),
(2) Date: Nov. 5, 2019

(87) PCT Pub. No.: WO2019/009609
PCT Pub. Date: Jan. 10, 2019

(65) Prior Publication Data

US 2020/0165766 A1 May 28, 2020

(30) Foreign Application Priority Data

Jul. 4, 2017 (KR) ..... 10-2017-0084687

(51) Int. Cl.
*D06F 23/04* (2006.01)
*D06F 37/16* (2006.01)
(Continued)

(52) U.S. Cl.
CPC ..... *D06F 37/16* (2013.01); *D06F 23/04* (2013.01); *D06F 31/00* (2013.01); *D06F 39/10* (2013.01); *D06F 39/02* (2013.01)

(58) Field of Classification Search
CPC ..... D06F 18/00; D06F 29/00; D06F 31/00; D06F 21/00; D06F 21/06; D06F 21/08;
(Continued)

(56) References Cited

U.S. PATENT DOCUMENTS 3,481,162 A * 12/1969 Ziegler ..... D06F 13/00 68/4
2011/0047714 A1* 3/2011 Kim ..... D06F 39/10 8/137
2015/0059417 A1 3/2015 Ramasco

FOREIGN PATENT DOCUMENTS

CN 105624976 6/2016
JP 2010-12143 1/2010
(Continued)

OTHER PUBLICATIONS

Written Opinion of the International Search Authority dated Sep. 19, 2018.

*Primary Examiner* — David G Cormier
(74) *Attorney, Agent, or Firm* — Birch, Stewart, Kolasch & Birch, LLP

(57) ABSTRACT

A laundry treating apparatus includes a tub for holding wash water, a drum rotatably supported in the tub and including a shaft disposed perpendicular with the ground, and a sub-drum detachably mounted to an inner circumferential surface of the drum. The sub-drum is configured to wash laundry independently from the drum. A discharging area of the sub-drum includes an inlet hole configured to draw wash water into the sub-drum, an outlet hole formed in a lateral wall of the sub-drum and configured to discharge the wash water outside the sub-drum, and a filter unit disposed under the discharging area and configured to filter wash water drawn into the sub-drum by rotation of the sub-drum.

7 Claims, 15 Drawing Sheets

(51) Int. Cl.
*D06F 31/00* (2006.01)
*D06F 39/10* (2006.01)
*D06F 39/02* (2006.01)

(58) Field of Classification Search
CPC ..... D06F 23/04; D06F 37/12; D06F 37/14; D06F 37/24; D06F 39/00; D06F 39/08; D06F 39/083; D06F 39/10; D06F 33/40; D06F 33/60; D06F 35/007; D06F 2103/42; D06F 2202/10; D06F 2204/06; D06F 2204/065; D06F 58/00; D06F 58/02; D06F 58/203; D06F 5/30; D06F 2202/00–12; D06F 2204/00–10; D06F 2210/00; D06F 2212/00; D06F 2212/02; D06F 2212/04; D06F 2212/06; D06F 2214/00; D06F 2216/00; D06F 2220/00; D06F 2222/00; D06F 2224/00; D06F 2226/00
See application file for complete search history.

(56) References Cited

FOREIGN PATENT DOCUMENTS

| | | |
|---|---|---|
| JP | 2010-136904 | 6/2010 |
| KR | 2000-0001694 | 1/2000 |
| KR | 10-2002-0008451 | 9/2002 |
| KR | 10-0353027 | 9/2002 |
| KR | 10-2016-0127676 | 11/2016 |

* cited by examiner

CLOTHING TREATMENT DEVICE AND METHOD FOR CONTROLLING SAME

CROSS-REFERENCE TO RELATED APPLICATIONS

This application is a U.S. National Phase of PCT International Application No. PCT/KR2018/007565, filed on Jul. 4, 2018, which claims priority under 35 U.S.C. 119(a) to Korean Patent Application No. 10-2017-0084687, filed in the Republic of Korea on Jul. 4, 2017, the contents of all of which are incorporated by reference herein in their entireties.

FIELD

Embodiments of the present disclosure relate to a laundry treating apparatus and a control method of the same, more particularly, to a laundry treating apparatus which includes a sub-drum additionally mounted in a drum so as to perform laundry-treating in both of the drum and sub-drum.

BACKGROUND

Generally, a laundry treating apparatus includes a washer configured to perform washing, a dryer configured to perform drying and a laundry machine with washing and drying functions configured to perform both washing and drying.

Such a laundry treating apparatus used as a washer may include a cabinet defining an external appearance; a tub mounted in the cabinet and configured to hold wash water; a drum rotatably provided in the tub and configured to wash clothes or laundry; and a door coupled to the cabinet and provided to facilitate the loading and unloading of the clothes or laundry.

The laundry treating apparatus may be classified into a top loading type having a drum shaft which is vertical with respect to the ground and a front loading type having a drum shaft which is horizontal and parallel with respect to the ground.

In the front loading type laundry treating apparatus, the drum shaft is substantially parallel with the ground and the washing is performed by using a frictional force between the laundry, the drum rotated by the drive force of a motor, and the drop impact of the laundry, in a state where detergent, wash water and laundry are loaded in the drum. Such the drum washing method has little damage to the laundry and little laundry entangling, while having a washing effect like hand-rubbing-and-striking.

In the top loading type laundry apparatus, the drum shaft is substantially vertical with respect to the ground and the drum is mounted in the tub where wash water is held. The washing is performed in a state where the laundry is submerged in the wash water supplied to the drum and the top loading drum laundry apparatus is categorized into a pulsator type and an agitator type. The pulsator type includes a pulsator which is rotatably oriented in a bottom of the drum configured to accommodate wash water and laundry and rotates the wash water and the laundry by rotating the pulsator so as to perform the washing. The agitator type includes an agitator which is projected from the bottom of the drum upwardly and rotates the wash water and the laundry by rotating the agitator so as to perform the washing.

The top loading type laundry treating apparatus is configured to perform the washing by using both the friction between the wash water and the laundry and the chemical action of the detergent which are facilitated by the rotation of the drum or the agitator or pulsator which is provided in the bottom of the drum to create water currents. Accordingly, wash water has to be supplied enough to submerge the laundry to perform the washing in the top loading type laundry treating apparatus and the top loading type laundry treating apparatus requires much wash water.

In the conventional laundry treating apparatus, a washing course, more specifically, the washing course configured of a wash cycle, a rinse cycle and a dry-spin cycle may be performed in one drum. If the laundry has to be sorted based on fabric materials, the washing course has to be performed at least two times and more operations of the laundry treating apparatus have to be performed. Accordingly, the conventional laundry treating apparatus has some disadvantages of detergent waste and energy consumption.

To solve such disadvantages, a laundry treating apparatus according to various embodiments of this disclosure may include a sub-drum detachably mounted in the drum. Such a sub-drum may accommodate water, independent from the tub, and water currents may be formed in the sub-drum by the rotation of the sub-drum so as to perform an additional washing course independently.

Washing for the main-drum and washing for the sub-drum may be independently performed. More specifically, the wash water held in the main-drum may not be mixed with the water held in the sub-drum. If the wash water held in the main-drum and the sub-drum is mixed, there may be an issue with dyeing the laundry. Also, the detergent used for the laundry in the main-drum could be different from the detergent used for the laundry in the sub-drum.

More specifically, it may be desirable that the water supplied to either of the sub-drum or the drum is not mixed with water drained from the other of the sub-drum or the drum.

Accordingly, a laundry treating apparatus is disclosed that may effectively facilitate such independent washing processes.

SUMMARY

Technical Problem

To overcome the disadvantages of conventional apparatus, aspects of the present disclosure address the above-noted problems.

An aspect of the present disclosure is to provide a laundry treating apparatus which includes a sub-drum easily mountable in a main-drum and which may independently separate the washing for the main-drum from the washing for the sub-drum. A laundry treating apparatus according to this aspect may substantially separate water supply and water drainage from each other.

Furthermore, a further aspect of the present disclosure is to provide a laundry treating apparatus which may achieve a sufficient washing effect by using only the sub-drum.

Another aspect is to provide a laundry treating apparatus which may allow a user to additionally load laundry into the main-drum as well as into the sub-drum.

Yet another aspect is to provide a laundry treating apparatus which may effectively discharge wash water from the sub-drum, without being drawn into the main-drum.

Another aspect is to provide a laundry treating apparatus which may discharge the wash water held in the sub-drum only in a dry-spinning cycle, without discharging the wash water in a washing cycle. A laundry treating apparatus according to this aspect may include a water discharging structure without an auxiliary drive unit such as a drainage pump connected with the sub-drum.

According to still another aspect, a laundry treating apparatus may remove the lint generated in the sub-drum.

In yet another aspect of this disclosure, a laundry treating apparatus may effectively perform the independent discharging of wash water from the sub-drum by effectively removing the lint.

Technical Solution

A laundry treating apparatus according to various embodiments of this disclosure comprises a tub configured to hold wash water; a drum rotatably supported in the tub and comprising a shaft which is perpendicular with the ground; a sub-drum detachably mounted to an inner circumferential surface of the drum and configured to wash laundry, independent from the drum; a discharging area provided in the sub-drum and comprising an inlet hole configured to draw wash water into the sub-drum; and an outlet hole formed in a lateral wall of the sub-drum and configured to discharge the wash water outside the sub-drum; and a filter unit provided under the discharging area and configured to filter the wash water moved by the rotation of the sub-drum and passing therethrough.

The filter unit may be detachably provided, in other words, separable to be cleaned.

The filter unit may be provided under the inlet hole to draw the wash water raised by a centrifugal force generated by the rotation of the sub-drum into the discharging area via the filter unit. Accordingly, the wash water may be basically filtered by the filter unit and discharged, before drawn into the discharging area. The discharging area may be prevented from being clogged with lint or foreign substances in advance.

The filter unit may be provided in an upper end of the sub-drum to filter the wash water rising along an inner circumferential surface of the sub-drum.

The discharging area may be provided in a lateral wall of the sub-drum, and the filter unit may extend more from the side wall of the sub-drum towards a center of the sub-drum than the filter unit extends from the discharging area.

The discharging area may be provided in a cover of the sub-drum and the filter unit located under the cover of the sub-drum may be provided to cover the discharging area. Accordingly, only the wash water having passed the filter unit may be drawn into the discharging area.

The filter unit may comprise a body extended towards a center of the sub-drum from the lateral wall of the sub-drum to cross the flow direction of the rising wash water; a through-hole penetrating the body; and a filter provided in the through-hole and configured to filter the wash water.

The laundry treating apparatus may further comprise a detergent box provided in the sub-drum to accommodate a washing detergent and retractable towards a center of the sub-drum, wherein the filter unit is fixed to the detergent box and retractable with respect to the sub-drum, together with the detergent box.

A cross-section of the drum may be formed circular, and the sub-drum may comprise one or more coupling areas coupled to an inner circumferential surface of the drum; and one or more spaced areas alternately provided with respect to the one or more coupling areas along a circumference of an upper end of the sub-drum and spaced a preset distance apart from the inner circumferential surface of the drum.

The filter unit may be provided adjacent to the one or more coupling areas.

The laundry treating apparatus may further comprise a path area defined in the sub-drum and providing a path for the wash water raised by a centrifugal force generated by the rotation of the sub-drum, wherein the filter unit is provided in the path area to filter the wash water flowing along the path area.

The filter unit may comprise a body provided to accommodate wash water; a filter unit inlet hole provided to draw wash water from the path area into the body; a filter configured to filter the wash water drawn into the body and discharge the filtered wash water to the sub-drum; and a filter unit outlet hole configured to discharge the wash water not filtered by the filter into the path area out of the wash water drawn into the body.

The filter unit outlet hole may be provided above the filter to selectively discharge the wash water according to the size of the centrifugal force.

The body may comprise a front panel having the filter fixed thereto and oriented towards the inside of the sub-drum; and a flange projected from the front panel towards an inner circumferential surface of the sub-drum to be attachable and detachable with respect to the path area.

The filter unit inlet hole may be provided in a lower end of the flange and the filter unit outlet hole is provided in an upper end of the flange.

The path area may comprise a path body defining a path for the wash water; a lower opening provided in a lower end of the path body and configured to draw wash water from the sub-drum; an upper opening provided in an upper end of the path body and configured to discharge the drawn wash water; and an accommodation area configured to accommodate the filter unit.

The upper opening may be provided above the outlet hole.

The path body may be projected from an inner circumferential surface of the sub-drum to form a water current in the sub-drum.

A cross-section of the drum may be formed circular, and the sub-drum may comprise one or more coupling areas coupled to an inner circumferential surface of the drum; and one or more spaced areas alternately provided with respect to the one or more coupling areas along a circumference of an upper end of the sub-drum and spaced a preset distance apart from the inner circumferential surface of the drum.

The filter unit may be provided adjacent to the one or more coupling areas.

The laundry treating apparatus may further comprise a guide rib projected from a lateral wall of the sub-drum to collide with a water current formed by the rotation of the sub-drum, wherein the filter unit is provided in the guide rib to filter the wash water colliding with the guide rib.

The guide rib may be provided in the distant area.

The filter unit may comprise a body providing an accommodation space configured to accommodate wash water; a body communication hole provided in the body and configured to facilitate communication between the accommodation space and the inside of the sub-drum; and a filter provided in the body communication hole and configured to filter the wash water, and the accommodation space becomes wider towards the lateral wall of the sub-drum.

The body may be formed to surround the guide rib, and a cross section of the body may become wider toward a lateral wall of the guide rib.

Detailed characteristics of the embodiments may be realized combinedly in other embodiments, only if they are contradictory or exclusive.

Advantageous Effects

The embodiments have following advantageous effects. According to the embodiments of the present disclosure, the laundry treating apparatus includes a sub-drum easily mountable in a main-drum and which may independently separate the washing for the main-drum from the washing for the sub-drum. Especially, the object is to provide a laundry treating apparatus which may substantially separate water supply and water drainage from each other.

Furthermore, the laundry treating apparatus may achieve a sufficient washing effect by using only the sub-drum.

Still further, the laundry treating apparatus may allow a user to additionally load laundry into the main-drum as well as the sub-drum.

Still further, the laundry treating apparatus may effectively discharge wash water from the sub-drum, without being drawn into the main-drum.

Still further, the laundry treating apparatus may discharge the wash water held in the sub-drum only in a dry-spinning cycle, without discharging the wash water in a washing cycle. Especially, the laundry treating apparatus may realize the object of the water discharging structure, without an auxiliary drive unit such as a drainage pump connected with the sub-drum.

Still further, the laundry treating apparatus may remove the lint generated in the sub-drum.

Still further, the laundry treating apparatus may effectively perform the independent discharging of wash water from the sub-drum by effectively removing the lint.

DETAILED DESCRIPTION

Referring to the accompanying drawings, exemplary embodiments of the present disclosure will be described in detail. Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

Figure 1:
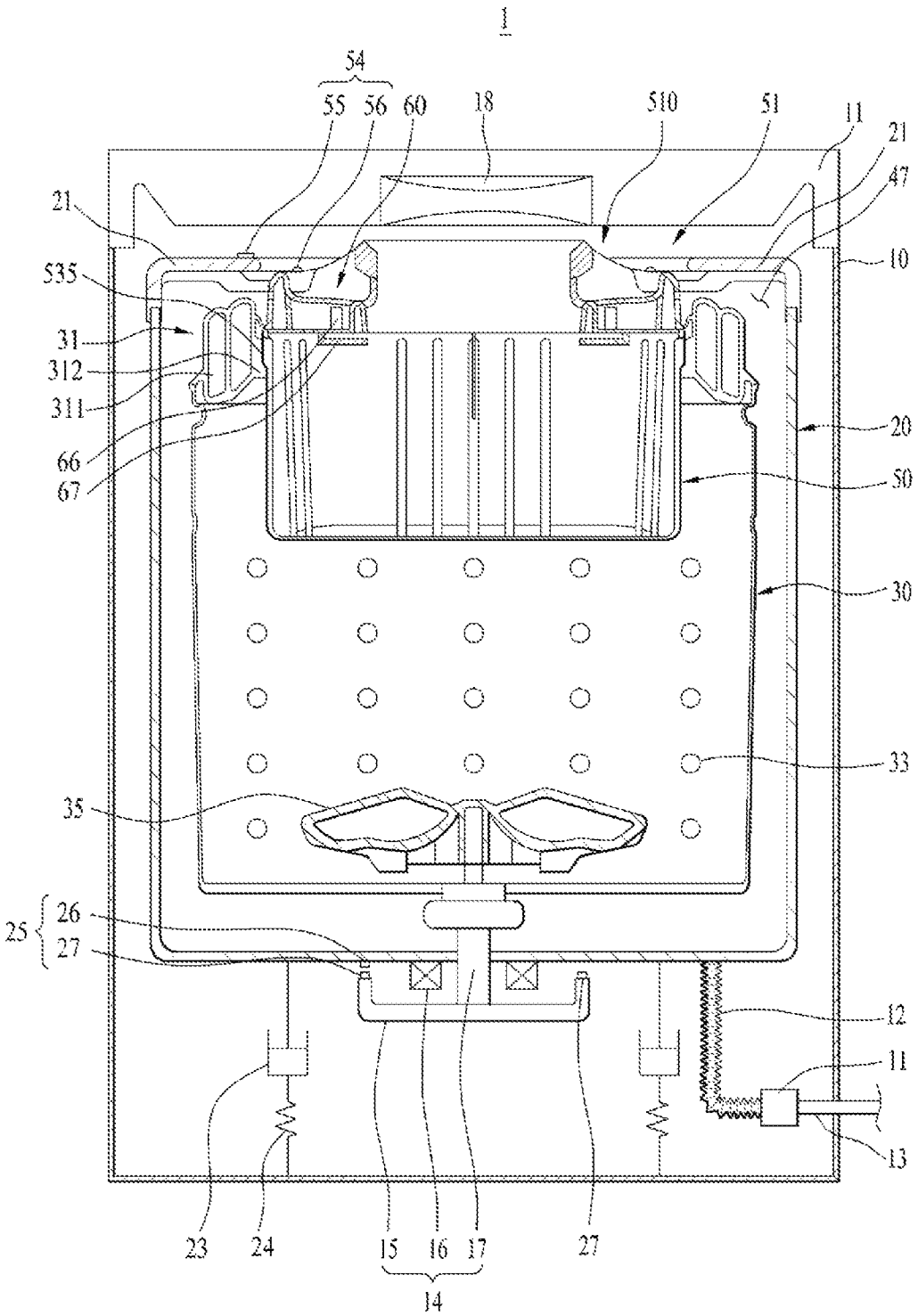
FIG. 1 is a schematic diagram illustrating a structure of a laundry treating apparatus in accordance with one embodiment of the present disclosure.

FIG. 1 is a schematic diagram illustrating a structure of a laundry treating apparatus 1 in accordance with one embodiment of the present disclosure;

Referring to FIG. 1, the laundry treating apparatus 1 in accordance with the embodiment includes a cabinet 10 having an opening formed in an upper portion to load clothes or laundry (hereinafter, the laundry); a door (not shown) coupled to the opening to open and close the opening; a tub 20 mounted in the cabinet 10 and configured to store wash water; and a drum 30 rotatably mounted in the tub 20.

The laundry treating apparatus may further include a drive unit 14 configured to drive the drum 30; and a pulsator 35 configured to rotate in the drum 30 so as to form water currents in the wash water supplied to the drum and the tub.

The drive unit 14 may be provided to selectively rotate the drum 30 and the pulsator 35.

Meanwhile, the laundry treating apparatus in accordance with the embodiment includes a sub-drum 50 detachably mounted in the drum 30 and configured to perform washing, independent from the washing in the drum 30.

In the embodiments of the present disclosure, the wash water for washing the laundry and the wash water for washing the door and the like are referred to as 'the wash water' and the drum 30 is referred to as 'the main-drum'.

FIG. 1 shows a direct-type motor drive structure which directly connects the motor to a shaft 17 to drive the drum 30. However, the laundry treating apparatus 1 in accordance with the illustrated embodiment is not limited thereto.

The cabinet 10 may define the exterior appearance of the laundry treating apparatus 1 and include a cabinet cover 11 having an opening to communicate the inside of the cabinet with the outside so as to load the laundry.

The cabinet cover 11 is provided in an upper end of the cabinet 10 and the door (not shown) is rotatably coupled to a top of the opening to selectively open and close the opening. Accordingly, a user is able to load or unload the laundry into or from the drum 30 and the sub-drum by opening and closing the door.

Meanwhile, a water supply unit 18 is provided in the cabinet cover 11 to supply the water mixed with detergent or clean water with no detergent to the drum 30 and the sub-drum 50. The wash water exhausted from the water supply unit 18 may be supplied to the drum 30 and/or the sub-drum 50.

The wash water exhausted from the water supply unit 18 may be supplied only to the drum 30 or only to the sub-drum 50. A laundry accommodating space of the drum 30 may be separated from a laundry accommodating space of the sub-drum 50 and the wash water supplied to the drum 30 may be separated from the wash water supplied to the sub-drum 50. In other words, the supply of the wash water supplied to the sub-drum 50 and to the drum 30 may be respectively limited, because a contamination level or fabric type of the laundry loaded in the drum could be different from a contamination level or fabric type of the laundry loaded in the sub-drum. Accordingly, the laundry and the wash water supplied to the drum may be separated from the laundry and the wash water supplied to the sub-drum.

In the illustrated embodiment, the wash water is selectively supplied to the drum 30 or the sub-drum 50 via the inside of the tub 20 based on the rotation of the sub-drum 50. In other words, the wash water may be directly supplied to the internal space of the drum 30, not passing through the internal space of the sub-drum and the internal space of the sub-drum 50, not passing through the internal space of the drum 30. The wash water supplied to the drum 30 and the wash water supplied to the sub-drum 50 are not mixed during the wash cycle and it may be preferred that they are not mixed in the internal space of the drum 30 and the internal space of the sub-drum 50 even during the dry-spin cycle and the water drainage process.

The tub 20 is formed in a cylinder shape with an open top and mounted in the cabinet 10 to accommodate the wash water. The tub 20 includes a tub cover 21 installed to an upper end.

The tub cover 21 may be located higher than an upper end of the drum 30 and an upper end of the sub-drum 50 mounted in the drum 50. A laundry introduction opening 580 is formed in the tub cover 21, corresponding to the opening of the cabinet 10. The laundry may be loaded into the drum or the sub-drum via the laundry introduction opening 580.

A lower surface of the tub 20 is flexibly supported by a spring 24 and a damper 23 which are installed in the cabinet 10. As the lower surface is directly supported by the spring 24 and the damper 23, the tub 20 cannot be rotary as it is so that the tub may not be provided with an auxiliary rotational force by the drive unit 14, different from the drum 30. FIG. 1 shows that the spring 24 and the damper 23 are serially connected to the lower surface of the tub 20 and the embodiments of the present disclosure are not limited thereto. If necessary, the spring 24 and the damper 23 may be connected to the lower surface in parallel. Alternatively, the damper 23 may be connected to the lower surface of the tub 20 and the spring 24 may be connected to an upper surface of the tub 20 and vice versa.

A drainage mechanism configured to drain water may be connected to the lower surface of the tub 20. The drainage mechanism includes a drainage pump 11 for providing a power to drain the wash water held in the tub 20; a first drainage pipe 12 having one end connected to the lower surface of the tub and the other end connected with the drainage pump 11 so as to guide the wash water toward the drainage pump 11; and a second drainage pipe 13 having one end connected with the drainage pump 11 and the other end connected with one side of the cabinet 10 so as to drain the wash water outside the cabinet 10 from the drainage pump 11. The first drainage pipe 12 may be a bellows pipe not to transfer the vibration of the tub 20 to the drainage pump 11.

The drive unit 14 includes a motor configured of a rotor 15 and a stator 16; and a shaft 17 connected with the rotor 15. As a clutch (not shown) is provided in the drive unit 14, the drive force may be transferred to the drum 30 and the pulsator 35. For example, when the shaft 17 is selectively coupled to the drum 30 in a state of being fixed to the pulsator 35, the drive unit 14 may transfer the drive force to the pulsator 35 or both of the pulsator 35 and the drum 30. As another example, the shaft 17 is selectively coupled to the pulsator in a state of being fixed to the drum 30 and the drive unit 14 may then transfer the drive force to the drum 30 or both of the pulsator 35 and the drum 30.

As mentioned above, the shaft 17 may be fixed to one of the pulsator 35 and the drum 30 and selectively coupled to the other one. However, such the description may not exclude the structure configured to selectively couple the shaft only to the pulsator 35 or the drum 30.

The laundry treating apparatus 1 in accordance with one embodiment includes the drum 30 rotatably mounted in the tub 20 and configured to hold clothes or laundry; and the sub-drum 50 detachably mounted in the drum 30.

The drum 30 may be formed in a cylinder shape with an open top and an approximately circular cross-section and a lower surface directly connected with the shaft 17 to receive the rotational force from the drive unit 14.

The drum 30 may be formed in the cylinder shape with the open top and a plurality of through-holes may be formed in a lateral wall, in other words, a circumferential surface. The drum 30 may be in communication with the tub 20 via the plurality of the through-holes 33. Accordingly, when wash water is supplied to the tub 20 to a preset water level or more, the drum 30 becomes submerged in the wash water and some of the wash water may flow into the drum via the through-holes 33.

The drum 30 includes a drum cover 31 provided in an upper end. The drum cover 31 is formed in a hollow ring shape and arranged in a lower area of the tub. An outlet path 47 is horizontally extended by the upper surface of the drum cover 31 and the lower surface of the tub cover 21. The outlet path 47 may be provided to guide the wash water exhausted outside via a lateral surface of the sub-drum 50 toward the inside of the tub 20 again.

The wash water held in the drum 30 is drawn toward inner and lower walls of the tub via the through-holes 33 of the drum 30 and then drained. The wash water held in the sub-drum 50 is drawn toward the inner wall of the tub via the top of the sub-drum 50. In other words, the wash water is flowing in a side gap between the drum 30 and the tub 20 via the outlet path 47 and then to the lower wall of the tub to be drained outside. Accordingly, the wash water held in both the drum 30 and the sub-drum 50 is not mixed with each other in the drum 30 and the sub-drum 50, when drained outside. Also, the wash water supplied to both the drum 30 and the sub-drum 50 is not mixed with each other.

The drum cover 31 has an opening so as to load the laundry or mount the sub-drum 50 therein. Also, the drum-cover 31 also has a balancer 311 provided to compensate the unbalance caused by the eccentric load of the laundry in the drum.

The drum cover 31 may include a first uneven portion 315 formed in an inner circumferential surface to facilitate the demounting of the sub-drum 50; and an hooking portion 312 projected from the inner circumferential surface to prevent the upward movement of the drum 30 by interfering with a coupling unit 93 of the sub-drum 50 which is provided to be coupled to the first uneven portion 315. In this instance, the coupling unit 93 is able to be flexibly movable into or from the sub-drum 50, in communication with a handle unit 510.

Figure 5:
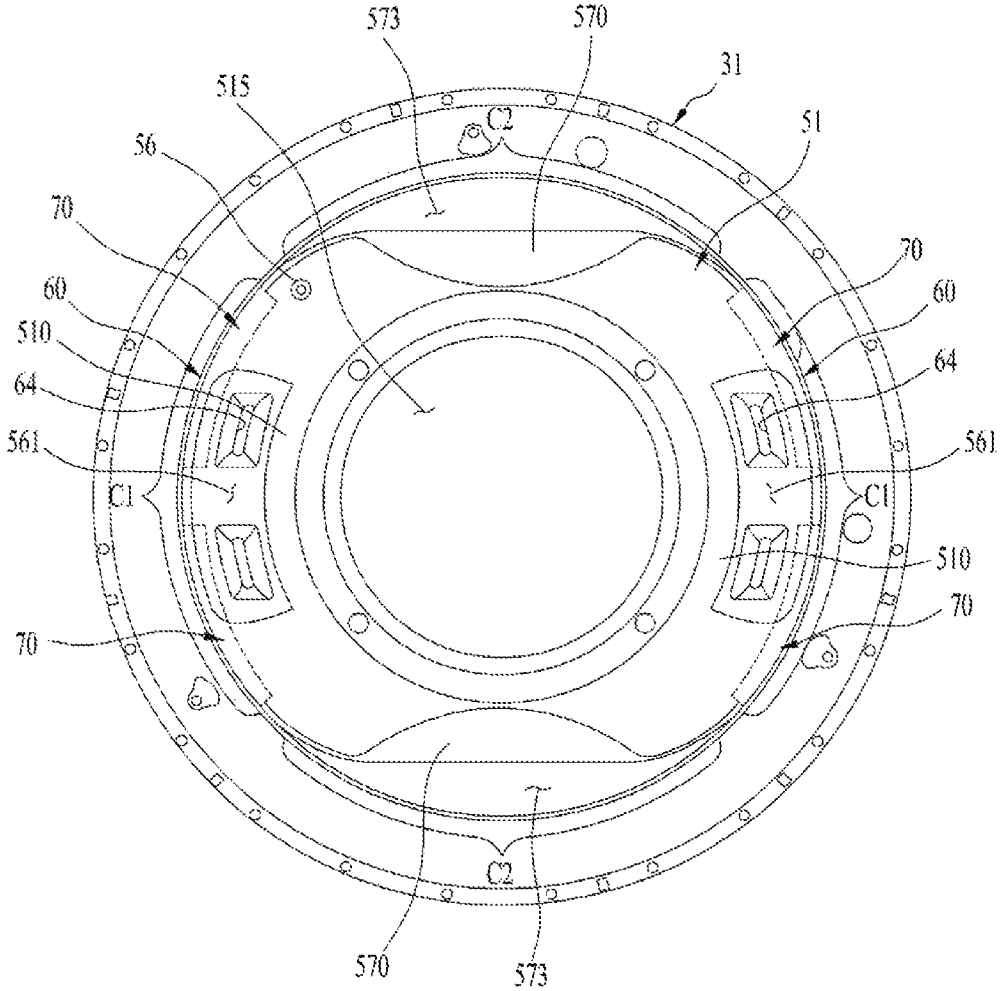
FIG. 5 is a plane view illustrating the sub-drum mounted in a drum.
Figure 6:
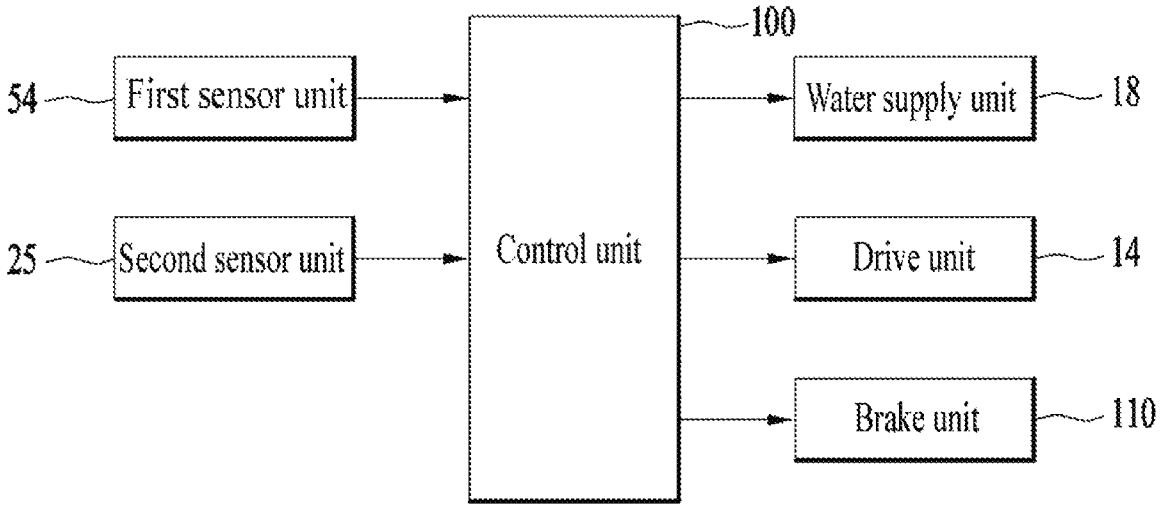
FIG. 6 is a block diagram illustrating the structure of the laundry treating apparatus in accordance with the embodiment.

Meanwhile, the laundry treating apparatus in accordance with the embodiment may include a control unit (500, see FIG. 5 and a brake unit (110, see FIG. 5) so as to control the overall washing process. Also, the laundry treating apparatus may include a sensor unit configured to control an angle of the sub-drum 50 which will be described later. The sensor unit may include a first sensor unit 54 and a second sensor unit 25. The angle control of the sub-drum 50 may be performed for the water supply. As one example, it may be determined based on the angle control of the sub-drum 50 whether to perform the water supply to the inside of the drum 30 via the same water supply unit or to the inside of the sub-drum 50.

The first sensor unit 54 may include a first hall sensor 55 and a first magnet unit 56. The first hall sensor 55 may be provided in an upper surface of the tub cover or an inner circumference of the tub cover 20. In other words, the first hall sensor 55 may be provided in one of the fixed elements.

The first magnet unit 56 may be installed on an upper surface of the sub-drum to be sensed by the first hall sensor 55.

When the sub-drum 50 is rotated, the first hall sensor 55 senses the first magnet unit 56 and transmits a signal to the control unit 100. In the illustrated embodiment, one hall sensor and one magnet are provided in the first sensor unit 54 for easy understanding. However, the embodiments of the present disclosure are not limited thereto and the first sensor unit 54 may include a plurality of hall sensors and a plurality of magnets. Or, it may include one hall sensor and the plurality of the magnets. The plurality of the magnets may be arranged at intervals having a preset angle. When one magnet is provided in one hall sensor, the hall sensor may generate one magnet sensing signal per one rotation of the sub-drum 50. When three magnets are provided in one hall sensor, the hall sensor may generate three magnet sensing signals per one rotation of the sub-drum 50. The first sensor unit 54 may determine whether the sub-drum 50 is mounted in the drum 30. Also, the first sensor unit 54 may determine whether the sub-drum 50 is mounted in the drum 30 normally.

As one example, when the first hall sensor 55 generates three magnet sensing signals per one rotation of the drum 30, the first hall sensor 55 may generate only two magnet sensing signals. In this instance, it may be determined that the sub-drum 50 is mounted in the drum abnormally.

When it is determined that the sub-drum 50 is mounted in the drum 30 normally, the sub-drum 50 and the drum 30 may be integrally rotated as one body. In other words, the rotation angle of the sub-drum 50 may be controlled by controlling the rotation angle of the drum 30.

In this embodiment, the second sensor unit 25 may be provided to control the rotation angle of the drum 30. More specifically, the sensor unit 25 may be provided to sense the rotation angle of the drum 30 and the rotation angle of the drum 30 may be controlled based on the result of the sensing of the second sensor unit.

More specifically, the second sensor unit 25 may include one second hall sensor 26 and a second magnet unit 27 so as to sense the rotation angle of the drum 30. The second hall sensor 26 may be provided on a bottom surface of the tub 20 and magnets of the second magnet unit 27 may be arranged along an outer circumference of a top surface of the rotor 15 to be sensed by the second hall sensor 26. When the drum 30 is rotated, the second hall sensor 26 senses the rotation angle of the drum 30 and then transmits a signal to the control unit 100. To allow the second sensor unit 25 to sense the precise rotation angle of the drum 30, the magnets of the second magnet unit 27 are provided on the rotor 15 at the equidistant intervals. The more magnets are provided, the more precise rotation angle of the drum may be sensed. In other words, the rotation angle of the drum 30 is determined based on the rotation angle of the rotor 15 sensed by the second sensor unit 25. Meanwhile, the second sensor unit 25 may include the hall sensor fixedly provided on the stator; and a plurality of magnets provided on the rotor and rotatable together with the rotor.

Meanwhile, the rotation angle of the rotor 15 may be sensed without auxiliary sensor. In other words, the rotation angle of the rotor 15 may be sensed according to a sensorless method to determine the rotation angle of the drum 30. Such a sensorless method may be configured to allow a phase current of a preset frequency to flow to the motor and estimate the location of the rotor provided in the motor based on the output currents detected while the currents of the preset frequency flow to the motor. Such the sensorless method is well-known knowledge and detailed description thereof will be omitted accordingly.

The control unit 100 is configured to control the overall operation of the laundry treating apparatus (e.g., the wash cycle, the rinse cycle, the dry-spin cycle and the like) and operate the laundry treating apparatus according to the user's setting.

Especially, the control unit 100 may be implemented to receive the signals generated by the first sensor unit 54 and the second sensor unit 25 and control the drive unit 14 configured to rotate the drum 30, the water supply unit 18 configured to supply wash water and the brake unit 110 configured to apply a brake to the rotating drum 30 based on the received signals. The control unit may perform the control of the rotation angle of the sub-drum 50 based on the control of the rotation angle of the drum 30. In other words, the control unit may control the sub-drum 50 to stop at a desired rotation angle.

The brake unit 110 is implemented to stop the drum 30 by applying a brake to the rotating drum 30. In other words, the control unit may control the drum 30 and the sub-drum 50 to stop at a preset rotation angle.

Hereinafter, the sub-drum 50 will be described in detail, referring to FIGS. 2 through 4.

Figure 2:
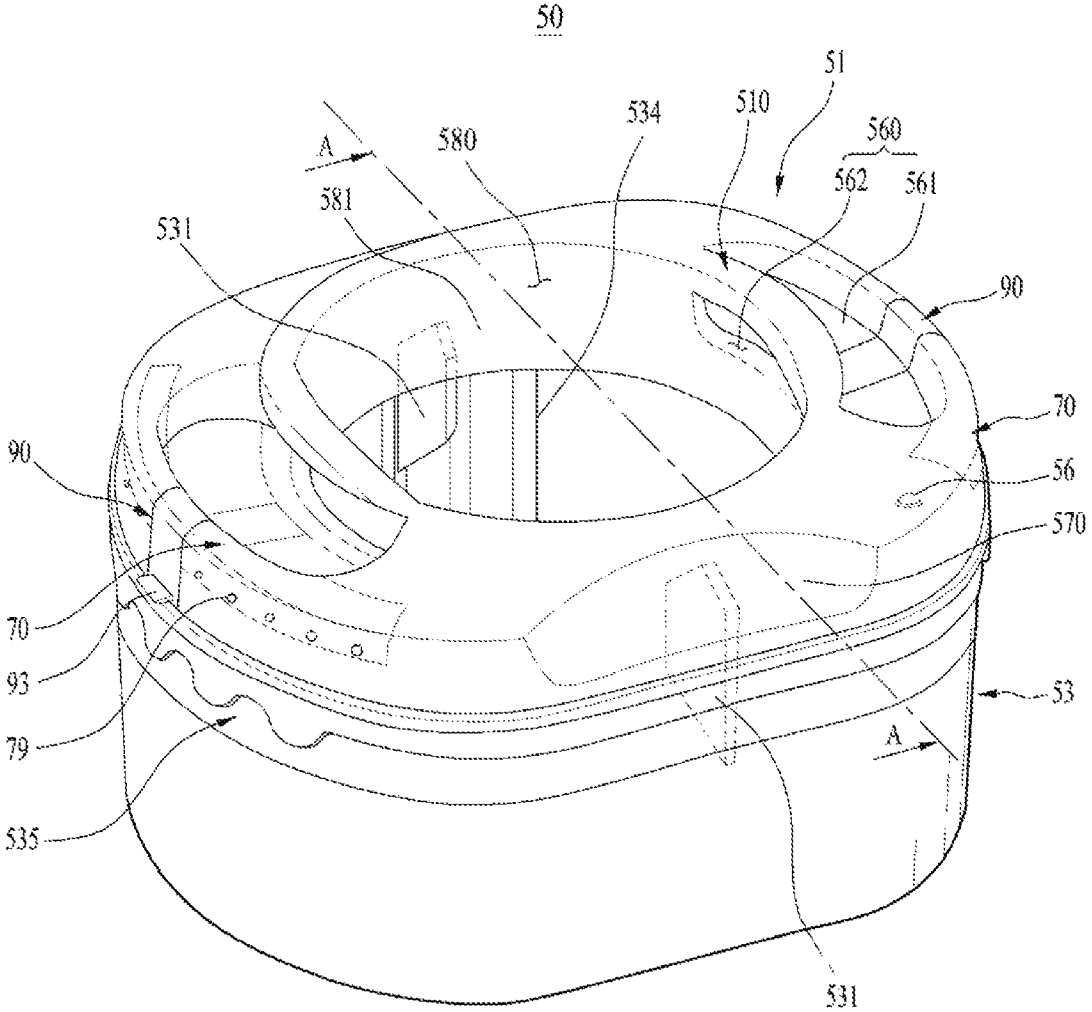
FIG. 2 is a perspective diagram illustrating a sub-drum which is shown in FIG. 1.

FIG. 2 is a perspective diagram illustrating the sub-drum 50 which is shown in FIG. 1. FIG. 3 is a sectional diagram along A-A line which is shown in FIG. 2. FIG. 4 is a plane view illustrating the sub-drum 50 mounted in the drum 30. FIG. 3 is an exploded perspective diagram of the sub-drum shown in FIG. 1. FIG. 4 is a sectional diagram along A-A line which is shown in FIG. 2. FIG. 5 is a plane view illustrating the sub-drum mounted in a drum.

Referring to FIGS. 2 through 5, the sub-drum 50 may be detachably mounted in an upper end area of the drum 30. The sub-drum 50 has a kind of a container shape with an open top. The laundry may be loaded or unloaded through the open top. Also, wash water may be supplied to the internal space of the sub-drum via the open top and a cross section of the sub-drum may be formed in an approximately circular shape.

The sub-drum 50 may be configured to perform the washing, independent from the drum 30. After the laundry is sorted according to the color or fabric type and dividedly loaded into the drum 30 and the sub-drum 50 and washing is performed for the laundry supplied to the drum and the sub-drum simultaneously. Accordingly, the operation frequency of the laundry treating apparatus 1 may be reduced and the waste of the wash water, detergent and energy may be prevented at the same time. Also, the laundry may be sorted according to a contamination degree or the user's intended use of the laundry. As one example, laundry items such as lingerie or underwear may be dividedly washed from the laundry items which are used in cleaning such that the user's satisfaction level about the separated washing may be remarkably enhanced. In addition, the water supply and drainage may be separately performed and the separated washing effect may be substantially enhanced.

The sub-drum 50 may perform the washing while being rotated by the rotational force transmitted from the drum 30 such that no auxiliary drive device may be provided. That is because the sub-drum is integrally rotated together with the drum.

The sub-drum 50 includes a sub-drum body 53 formed in a cylinder shape with an open top; a sub-drum cover 51 detachably coupled to an upper end of the sub-drum body 53; an outlet unit 70 configured to exhaust the wash water held in the sub-drum 50 outside when the sub-drum 50 is rotated at a high speed; and a coupling unit 93 configured to couple and decouple the sub-drum 50 to and from the drum 30.

The sub-drum body 53 has an oval cross section so as to form a vortex in the wash water and a friction rib 534 may be provided in an inner circumferential surface of the sub-drum body 53 to form a water current in the wash water.

The top loading type laundry treating apparatus 1 in accordance with the embodiment may perform the washing process by using the chemical action of the detergent and the friction between the water currents formed by the rotation of the drum and the laundry. The sub-drum body 53 having the oval-shaped cross section may generate the vortex by using the rotation more efficiently than the drum having the circular-shaped cross section. As the vortex increases the friction between the wash water and the laundry, the sub drum 50 having the oval-shaped cross section may enhance the washing efficiency.

Meanwhile, the sub-drum body 53 may include an inner circumferential surface formed with a first curvature area (C1) having a first curvature and a second curvature area (C2) having a second curvature which is smaller than the first curvature, as shown in FIG. 5.

A pair of first curvature areas (C1) may be formed in the areas of the sub-drum body 53 which face each other, respectively, and the first curvature is identical to the curvature of the inner circumferential surface of the opening formed in the drum cover 31.

A pair of second curvature areas (C2) may be formed in the opposite areas of the sub-drum body 53 which face each other, respectively, with being located between the first curvature areas (C1). The second curvature may be smaller than the first curvature.

In other words, the first curvature areas (C1) and the second curvature areas (C2) may be alternatively provided along a circumference of the cross sectional surface formed in the sub-drum body 53.

The inner circumferential surface of the sub-drum body 53 may be divided into a short distance area (C2) spaced a first distance apart from the rotational center of the sub-drum 50; and a long distance area (C1) spaced a second distance apart from the rotation center of the sub-drum 50, the second distance farther than the first distance. The long distance area (C1) corresponds to the first curvature area (C1) and the short distance area (C2) corresponds to the second curvature area (C2).

Meanwhile, a first water supply path 573 which will be described later may be formed as the short distance area (C2) is spaced a sufficient distance apart from the inner circumferential surface of the drum-cover 31.

It is described that some area of the inner circumferential surface which the second curvature area (C2) indicates is curved but the embodiments of the present disclosure are not limited thereto. The area of the inner circumferential surface may be planar. In this instance, it is more appropriate that the second curvature area (C2) is named the short distance area (C2).

The first curvature area (C1), the second curvature area (C2), the long distance area (C1), the short distance area (C2), a coupling area (C1) and a distant area (C2) indicate specific areas. All of the areas which belong to the above-noted specific areas may be referred to as the terms mentioned above. In the disclosure, some areas of the sub-drum body 53 and the sub-drum body 51 are referred to as the above-noted terms.

Figure 4:
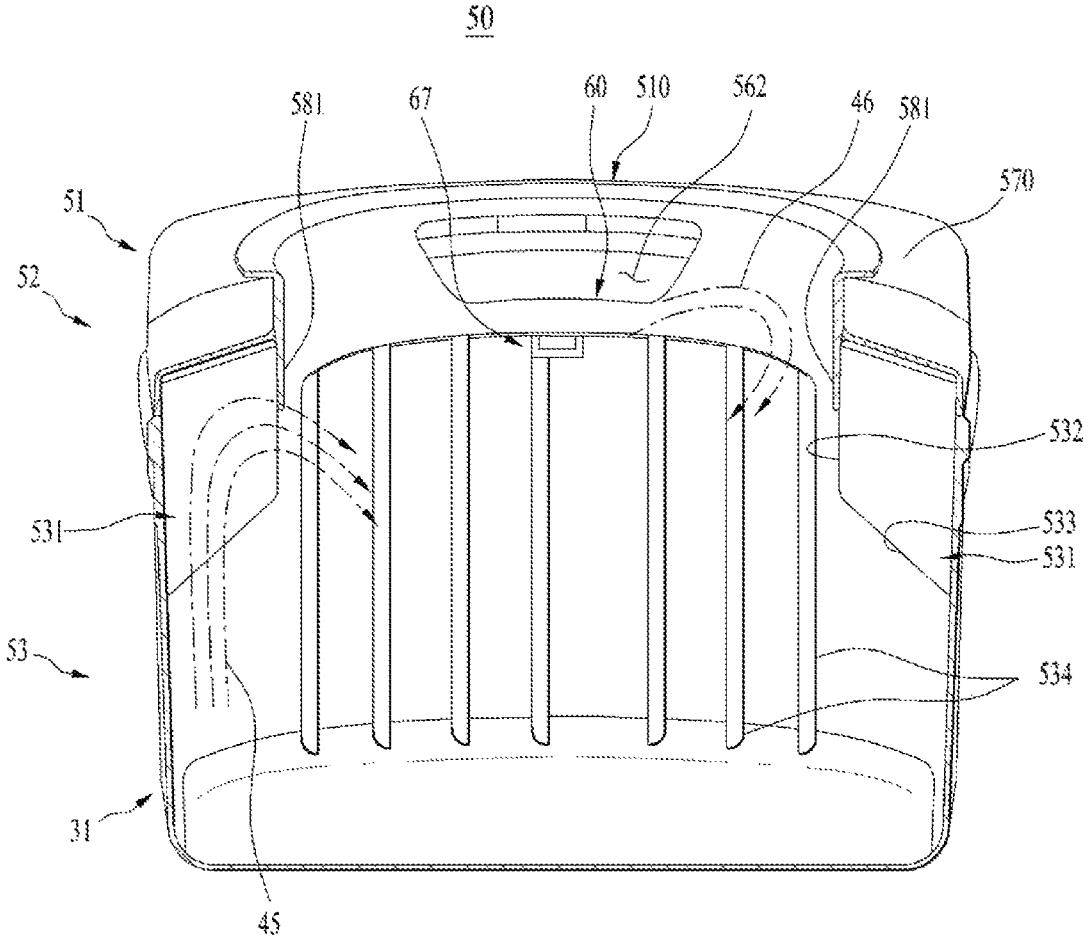
FIG. 4 is a sectional diagram along A-A line which is shown in FIG. 2.

It is shown in FIGS. 4 and 5 that the cross sectional surface of the sub-drum 50 is oval with respect to the overall height. However, the embodiments are not limited thereto. As one example, one short distance area (C2) may be formed or the short distance area (C2) may be formed only in the sub-drum body 53. In other words, the overall shape of the sub-drum cover 51 is circular and only the sub-drum body 51 provided in the lower area of the sub-drum cover 51 to hold wash water may have the short distance area (C2). Such the short distance area may define some space that vertically penetrates the drum from the drum upper portion into the drum inside. Accordingly, it is possible to form a penetrating area (not shown) in the sub-drum cover 51, corresponding to the short distance area.

Accordingly, as mentioned above, it is not necessary to form the overall shape of the sub-drum 50 in the oval shape so as to supply the wash water to the inside of the drum by vertically dropping the wash water via the water supply unit 18, without passing through the sub-drum 50. Any shapes are possible only if the short distance area for allowing the wash water to vertically flow is formed in the sub-drum body 51. The control of the drum rotation angle may be performed to locate such the short distance area to a corresponding area to the water supply unit 18.

Meanwhile, the sub-drum body 53 may include no through-holes 33 formed in the circumferential surface, different from the drum 30 including the through-holes 33 formed in the circumferential surface. Accordingly, the sub-drum body 53 may hold the wash water and the laundry and the wash water may not be exhausted into the drum 30 via the circumferential surface or lower surface. The wash water held in the tub 20 is only drawn into the drum 30 via the through-holes 33, not into the sub-drum 50.

The friction rib 534 may be projected from the inner circumferential surface of the sub-drum body 53 vertically. A plurality of friction ribs 534 may be spaced a preset distance apart from each other and integrally formed with the sub-drum body 53. The friction ribs 534 may be rotated the wash water in the rotational direction of the sub-drum body 53 by the frictional force with the wash water during the rotation of the sub-drum body 53. The friction ribs 534 are different from guide ribs 531, which will be described later, in the shape and functions.

The sub-drum cover 51 is coupled to an upper end of the sub-drum body 53, having a cross sectional surface which is equal to the cross sectional surface of the sub-drum body 53.

Accordingly, the circumferential surface of the sub-drum cover 51 may be divided into a first curvature area (C1) and a second curvature area (C2). The first curvature area (C1) may be named a first long distance area (C1) and the second curvature area (C2) may be named a second short distance area (C2). Different from the first and second curvature areas (C1) and (C2) of the sub-drum body 53, the first curvature area (C1) of the sub-drum cover 51 is coupled to the inner circumferential surface of the drum cover 31 and named a distant area (C2). Also, the second curvature area (C2) is spaced apart from the inner circumferential surface of the drum cover 31 and then named the distant area (C2).

The sub-drum cover 51 may include a laundry introduction opening 580 formed in an upper surface to introduce the laundry; and a handle unit 510 which provides a predetermined space to be grabbed by the user.

In addition, the sub-drum cover 51 may include an inner water supply guide 560 configured to guide the wash water exhausted from the water supply unit 18 into the sub-drum 50; and an outer water supply guide 570 configured to guide the wash water exhausted from the water supply unit into the drum 30 along an outer surface of the sub-drum 50.

The inner water supply guide 560 may function to guide the wash water supplied via the water supply unit 18 into the sub-drum smoothly, not into the drum simultaneously.

The outer water supply guide 560 may function to guide the wash water supplied via the water supply unit 18 into the drum smoothly, not into the sub-drum simultaneously.

The sub-drum cover 51 includes a guide rib 531 provided to lift the wash water circulating along the inner circumferential surface of the sub-drum body 53 after the flow direction is changed by collision and fall to the center of the sub-drum body 53.

The handle unit 510 may be formed in an upper surface of the sub-drum cover 51 and include a pair of handle units 510 facing each other.

The handle unit 510 may be arranged adjacent to the first curvature area (C1), in other words, the long distance area (C1) of the sub-drum cover 51. When the wash water is one-sided by the shock applied when the user demount the sub-drum 50 from the drum 30, rolling might occur in a left-and-right direction while the sub-drum 50 is rotating on a virtual axis passing the pair of the long distance areas (C1). When the handle unit 510 is provided near the second curvature area (C2), in other words, the short distance area (C2), the user has to apply a strong force so as to steady the vertical vibration of the sub-drum 50 such that it may be more advantageous to locate the handle unit 510 near the long distance area (C1).

The inner water supply guide 560 is provided in an upper surface of the sub-drum cover 51, more specifically, the long distance area (C1), in other words, a coupling area (C1). The inner water supply guide 560 may include a concave area 561 and a water supply hole 562.

To form the concave area 561, some area is recessed from the upper surface of the sub-drum cover 51 not to spread the wash water exhausted from the water supply unit 18 around after being collided against the upper surface of the sub-drum cover 51.

The water supply hole 562 is formed in an inner surface of the concave area toward the laundry introduction opening 580 to communicate the concave area 561 with the laundry introduction opening 580. Accordingly, as the wash water is guided to the laundry introduction opening 580 via the water supply hole 562 from the concave area 561, the water supply hole 562 may form a second water supply path 562 to guide the wash water to the sub-drum 50.

The wash water exhausted from the water supply unit 18 is temporarily stored in the concave area 561 such that the wash water may not be spread around the sub-drum cover 51 and then exhausted to the laundry introduction opening 580 via the water supply hole 562, in other words, the second water supply path 562 to be guided into the sub-drum 50.

Meanwhile, the concave area 561 and the water supply hole 562 may be formed in a lower area of the handle units 510 such that the spatial efficiency of the sub-drum cover 51 can be maximized.

The outer water supply guide 570 may be provided in the sub-drum cover 51, preferably, the short distance area (C2), in other words, the distant area (C2). More specifically, the outer water supply guide 570 may be spaced apart from the inner water supply guide 560. The sub-drum 50 may be rotated a preset angle together with the drum 30, to locate the inner water supply guide 560 and the outer water supply guide 570 under one water supply unit 18. Accordingly, even when the outer water supply guide 570 is separated from the inner water supply guide 560, the wash water exhausted from one water supply unit 18 may be supplied to the drum 30 and the sub-drum 50, respectively.

The outer water supply guide 570 is formed by recessing a corner of the distance area (C2) into the sub-drum cover 51 and a bottom surface is inclined outwards and downwards with respect to the sub-drum cover 51. The wash water exhausted from the water supply unit 18 may be guided into the drum 30 along the first water supply path 573 defined as the space formed between the distant area (C2) and the outer circumferential surface of the drum 30.

The guide rib 531 may be formed in a plate shape and provided under the upper surface of the sub-drum cover 51, being extended downwards. The guide rib 531 has one surface contacting with the inner circumferential surface of the sub-drum body 53. More specifically, the plate-shaped guide rib 531 has the top coupled to the sub-drum cover and one side surface in contact with the inner circumferential surface of the sub-drum body 53. Accordingly, the wash water held in the sub-drum body 53 is rotated along the inner circumferential surface of the sub-drum body 53 by the rotational force of the sub-drum 50 and the flow direction of the wash water is changed by the collision with the guide rib 531 to flow upwards and fall down to the center of the sub-drum 50 in an arc.

More specifically, the guide rib 531 may be formed in one surface toward the side surface toward the center of the sub-drum body 53. The guide rib 531 may include a rib vertical area 532 downwardly extended from the upper surface of the sub-drum cover 51; and a rib inclined area 533 formed in a lower surface toward the bottom of the sub-drum body 53, downwardly extended from the rib vertical area and the center of the sub-drum 50 toward the inner circumferential surface.

The rib inclined area 533 is spaced apart from the lower surface of the sub-drum body 53, while forming an acute angle with the inner circumferential surface of the sub-drum 50.

As the rib inclined area 533 is formed in the lower surface of the guide rib 531, the laundry rotated and flowing in the inside of the sub-drum body 53, together with the wash water, may be less interfered with. Accordingly, the flow of the laundry may be performed more efficiently and the friction between the laundry items may be increased enough to enhance the washing efficiency or performance.

Meanwhile, even if the rib inclined area 533 is formed in the guide rib 531, a sufficient amount of wash water can be lifted. For example, when the sub-drum 50 is rotated at a high speed, a water level of the wash water held in the inner circumferential surface of the sub-drum body 53 is higher than a water level of the wash water held in the center of the sub-drum body 53. Accordingly, even if the rib inclined area 533 is formed in the guide rib 531, sufficient wash water can be collided with the guide rib 531 to be lifted.

Meanwhile, when the sub-drum 50 is rotated at a relatively low speed, the guide rib 531 may be arranged in the short distance area (C2) of the sub-drum cover 51 to lift a sufficient amount of wash water. The amount of the wash water passing through a virtual section from the center of the sub-drum body 53 to the short distance area (C2) is equal to the amount of the wash water passing through a virtual section from the center of the sub-drum body 53 to the long distance area (C1). Accordingly, the water level of the wash water when passing through the virtual section to the short distance area (C2) from the center of the sub-drum body 53 is higher than the water level of the wash water when passing through the virtual section to the long distance area (C1) such that the guide rib 531 can lift the sufficient amount of the wash water even when the sub-drum 50 is rotated at the low speed.

The guide rib 531 has one surface configured to collide with the wash water and the other opposite surface, which are upwardly inclined toward the flow direction of the wash water. In other words, when viewing the guide rib 531 from the center of the sub-drum body 53 in a radial direction, the width of the lower cross section may be larger than the width of the upper cross section. Accordingly, the wash water may be lifted along the one surface and the other surface of the guide rib 531 more efficiently.

Figure 3:
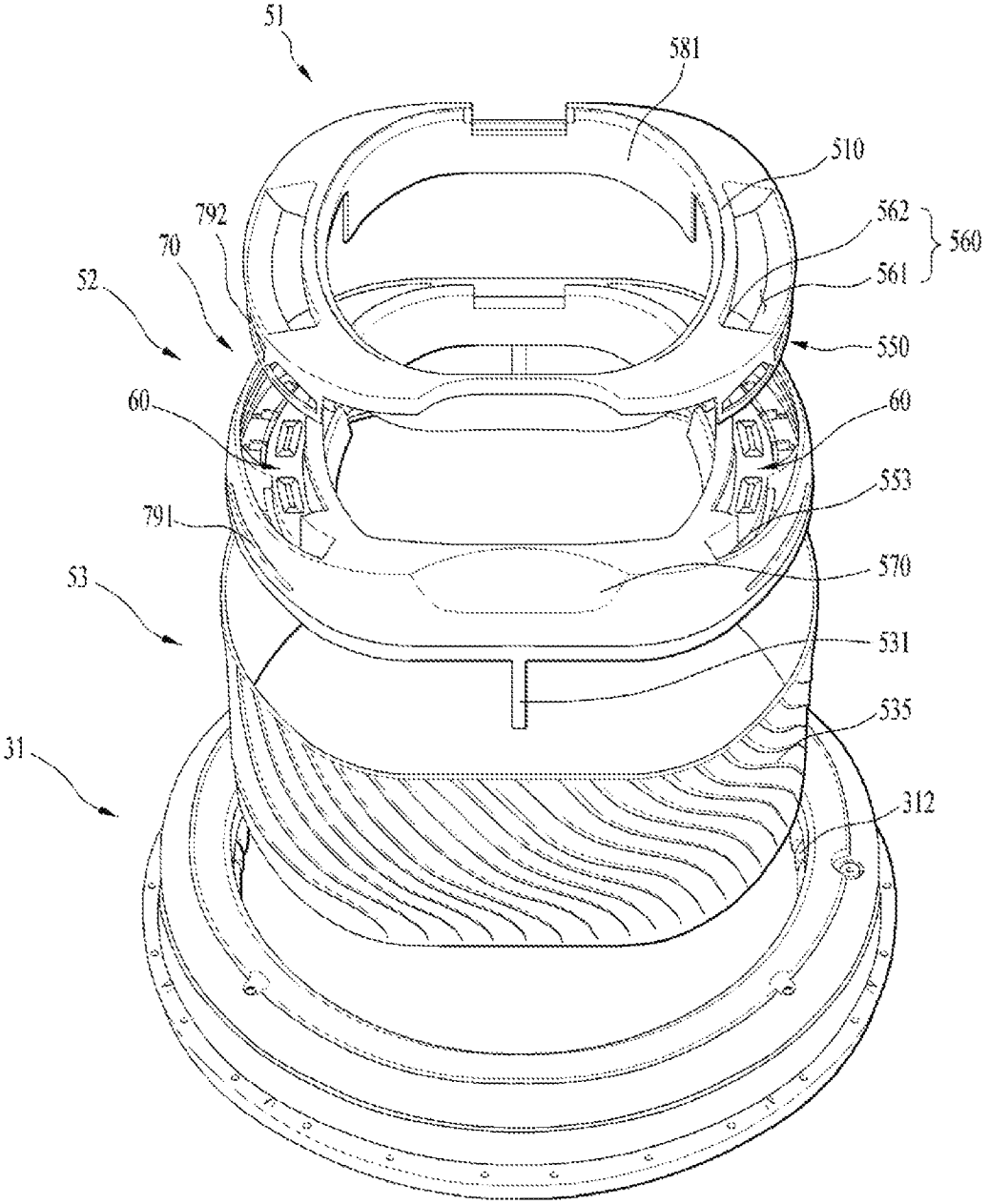
FIG. 3 is an exploded perspective diagram of the sub-drum shown in FIG. 1.

By experiments, it is shown in FIG. 3 that the high washing efficiency is generated together with an inclined guide, when the horizontal length and the height of the sub-drum 50 is 399 mm and 309.2 mm and the height (H) and the width (W) of the guide rib 531 are 70 mm and 65 mm. When the experiment is performed in a state the height (H) of the guide rib 531 is set as 50 mm and 90 mm with the other values are the same, more enhanced washing performance is gained for some contaminants but an average of the values is lower than an average when the height (H) of the guide rib 531 is set as 70 mm meanwhile, such the values are just one example gained by the experiments and specific values of the sub-drum 50 and the guide rib 531 are not limited thereto.

The pair of the guide ribs 531 is provided in the short distance area (C2), respectively, as mentioned above, and the embodiments are not limited thereto. More guide ribs 531 are provided in the long distance area (C1) to be two pairs.

The incline guide 581 may be provided above the guide rib 531 and downwardly inclined to the inside of the sub-drum 50. More specifically, the inclined guide 581 is formed along an inner area, in other words, an inner circumferential surface of the laundry introduction opening 580 provided above the guide rib 531.

Without the inclined guide 581, the wash water lifted by the guide rib 531 flows to an upper area of the inner circumferential surface of the sub-drum body 53 and then a lower area of the upper surface toward the center of the sub-drum body 53. After that, the wash water falls into the sub-drum body 53 freely, while drawing an arc.

When the inclined guide 581 is installed, the wash water will not fall freely. In other words, the wash water horizontally flowing along the lower area of the upper surface of the sub-drum cover 51 may form the flow 45 of which a direction is drastically changed downwards by the lower surface of the inclined guide 581. More specifically, the horizontal component speed is partially changed into the vertical component speed. The wash water of which the flow direction is drastically changed is collided against the laundry loaded in the sub-drum body 53 more strongly than the wash water falling down freely. At this time, the inclination angle (θ) of the inclined guide 581 may be set as approximately 10 degrees with respect to the direction of gravity. The angle at which the flow direction of the wash water is changed may be set larger. Accordingly, a stronger shock may be applied to the laundry loaded in the sub-drum body to enhance the washing performance.

It is described that the inclination angle (θ) is approximately 10 degrees and such the value is one of examples, not limited thereto.

Meanwhile, when the sub-drum 50 is rotated at a high speed, the wash water held in the sub-drum 50 could collide with each other to splash to the laundry introduction opening 580. At this time, the inclined guide 581 is configured to guide the splashed wash water into the sub-drum 50 along the upper surface so as to form the flow 46 to the sub-drum 50.

The sub-drum 50 has a second uneven area 535 formed in an outer circumferential surface to be seated on an inner circumferential surface of a balancer 311 while engaging with a first uneven area 315 formed in the balancer 311. Such the second uneven area 535 may be formed in the coupling area (C1) of the outer circumferential surface of the sub-drum body 53. It is preferred that the second uneven area 535 is not formed in the outer circumferential surface of the sub-drum cover 51. The wash water held in the sub-drum body 53 and the weight of the laundry might separate the sub-drum cover 51 from the sub-drum body 53.

The first uneven area 312 is projected from the inner circumferential surface of the drum cover 31. In addition, projections are upwardly projected from an upper end of the first uneven area 312. The first uneven area 312 is formed over the circumference of the inner circumferential surface of the drum cover 31.

The second uneven area 535 is projected from the outer circumferential surface of the sub-drum. The outer circumferential surface of the sub-drum is divided into a short distance area C2 and a long distance area C1. The long distance area may be coupled to the inner circumferential surface of the drum cover such that the second uneven area 535 may be formed in the long distance area. Projections are continuously and downwardly projected from a lower end of the second uneven area 535. The projections of the second uneven area 535 are configured to engage with the projections of the first uneven area 312.

Accordingly, the rotational force of the drum 30 may be transferred to the sub-drum 50 and the sub-drum 50 may be also rotated together with the drum 30. Meanwhile, the sub-drum 50 includes a discharging area 70 for discharging the water from the sub-drum 50 while the sub-drum 50 is rotated at a high rotation number. The discharging 70 is projected adjacent to a first curvature C1, in other words, the long distance area C1 and performs a function of selectively discharging the wash water held in the sub-drum 50 outside by the size of the centrifugal force generated during the rotation of the sub-drum 50.

As described above, the washing process performed by the sub-drum 50 is independently separated from the washing process performed by the drum 30. For that, water supply to the drum 30 has to be separated from water supply to the sub-drum 50. Moreover, the wash water supplied to the sub-drum 50 has to be held in the sub-drum 50 prevent the water from flowing into the drum 30 and the water has to be discharged from the sub-drum 50 in a drainage process and a dry-spinning process.

In other words, the sub-drum 50 has to hold wash water when rotated at a washing rpm to perform the washing and discharge the water when rotated at a dry-spinning rpm which is higher than the washing rpm.

At this time, the discharging area 70 is configured to discharge the water outside only when the centrifugal force generated by the rotation of the sub-drum 50 at the dry-spinning rpm higher than the washing rpm.

Such the discharging area 70 has a chamber (not shown) which accommodates water; an inlet hole (not shown) provided to draw water; and an outlet hole 79 provided to discharge the water from the chamber.

The discharging area 70 may be spaced a preset distance from a lateral wall of the sub-drum 50 in an inner radial direction, while the inlet hole is provided in a bottom surface of the chamber. Accordingly, the entire area of the inlet hole is smaller than the area of the chamber bottom surface with which the water is collided and a first resistance is generated when the water is drawn via the inlet hole. After that, a second resistance is additionally generated to raise the water against the centrifugal force, after flowing outside with respect to a radial direction.

Moreover, the discharging portion 70 has the outlet hole 791 provided above the inlet hole and penetrating the lateral wall of the sub-drum 50. Accordingly, when water is drawn into the chamber via the inlet hole, a third resistance is additionally generated to flow outside the radial direction of the sub-drum 50 and then to raise the water against the gravity.

Accordingly, when the sub-drum 50 is rotated at the washing rpm which is lower than the dry-spinning rpm, the wash water may not be discharged from the sub-drum 50. In other words, the wash water is set to be selectively discharged only when the sub-drum 50 is rotated at preset dry-spinning rpm. Of course, such selective discharging may be facilitated even without the configurations including a drainage valve or a drainage pump provided as control objects.

Meanwhile, the sub-drum 50 may include a body 53 configured to water and laundry; and a sub-cover coupled to an upper surface of the body 53 and having a laundry introduction opening 515 for loading the laundry.

In this instance, the second uneven area 535 is provided in an outer circumferential surface of the body 53 so as to prevent the sub-cover from being separated from the body 53 by the weight of the water and laundry loaded in the body 53. In addition, the discharging area 70, the guide rib 531, the handle unit 510, the inner water supply guide 560 and the outer water supply guide 570 may be also provided in the sub-cover.

Meanwhile, the sub-cover may be integrally formed as one body. Alternatively, as shown in FIG. 2, the sub-cover may include a lower cover 52 coupled to the upper end of the body 53; and an upper cover 51 coupled to a top of the lower cover 52.

The chamber (not shown) of the discharging area 70 is defined by the coupling between the lower cover 52 and the upper cover 51. In this instance, the inlet hole is provided in the lower cover 52. The outlet hole 79 may include a first outlet hole 791 provided in an upper end of the lower cover 52; and a second outlet hole 792 provided in an upper end of the upper cover 51. Accordingly, after water is drawn into the chamber via the inlet hole, the water is discharged via the outlet hole 79 configured of the second outlet hole 792 and the first outlet hole 791.

The concave area 561 forming the inner water supply guide 560 may be defined by the coupling between the lower cover 52 and the upper cover 51. An upper surface of the lower cover 52 may form a bottom surface of the concave area 561 and some inserted area of the upper cover 51 may form an inclined surface of the concave area 561. The water supply hole 562 forming the inner water supply guide 560 may be defined by the space distance from the handle unit 510 and the upper surface of the lower cover 52.

Meanwhile, a control method of the laundry treating apparatus 1 in accordance with one embodiment may determine whether the sub-drum 50 is mounted in the drum 30 before starting the washing or performing the water supply for the washing. Also, the control method may determine whether the sub-drum is mounted normally and it may be performed by using the first sensor unit 54.

In this instance, the control unit 100 performs preset determination processes based on the sensing signal transmitted from the first sensor unit 54 and the second sensor unit 25 or the sensing signal transmitted from the first sensor unit 54 and the output currents detected while predetermined frequency currents are flowing to the motor and control the water supply unit 18, the motor 14 and the brake unit 110 based on the result of the determination processes. The sensing signal transmitted from the second sensor unit 25 and the output currents detected while the preset frequency currents are flowing to the motor are used when the control unit 100 measures the rotation angle of the drum 30. Hereinafter, for easy and convenient description, the second sensor unit 25 is exemplified as the element configured to sense the rotation angle of the drum. Detailed description about the relation between the elements for the water supply will be omitted.

Meanwhile, the embodiment for the location control of the drum 30 and the sub-drum 50 to supply wash water is described. However, the location control of the drum 50 and the sub-drum 50 for the location control of the handle units 510 may be performed.

The user is able to separate the sub-drum 50 from the drum 30 while holding the handle units 510. Accordingly, it is preferred that the handle units 510 are determined to allow the user to easily grab the handle units 510 from the surface of the laundry treating apparatus. The location control of the drum 30 may be performed to locate the handle units 510 at a desired position.

More specifically, the location control of the sub-drum 50 may be performed at a place where the sub-drum 50 is decoupled. As one example, the location control may be performed to pause or end the washing course.

When the sub-drum 50 is mounted in the drum 30 only at a specific location, the location control of the drum may be performed for an easy coupling process. As one example, the location control may be performed to pause the washing without the sub-drum 50 or start and end the washing without the sub-drum 50.

In other words, the rotation location control of the drum and/or sub-drum 50 (the stopping of the drum and/or sub-drum 50 at a preset location) may be performed for the water supply and for easy and convenient mounting and/or demounting of the sub-drum.

Meanwhile, the laundry treating apparatus may be configured to perform one or more washing courses and include an auxiliary control panel configured to allow the user to select the washing courses. The control panel may include an input unit configured to receive diverse washing course inputs and a display unit configured to display the input washing courses.

On such the control panel may be provided the washing courses for the laundry loaded in the drum and no washing courses for the laundry loaded in the sub-drum 50. In this instance, once the sub-drum 50 is mounted, the laundry treating apparatus 1 may determine and implement a corresponding washing course to the sub-drum 50 out of the preset washing courses.

Accordingly, when trying to use the sub-drum 50 after mounting the sub-drum 50 in the conventional laundry treating apparatus 1 having no sub-drum 50, the user is able to use the control panel of the conventional laundry treating apparatus without change or fixing.

Figure 7:
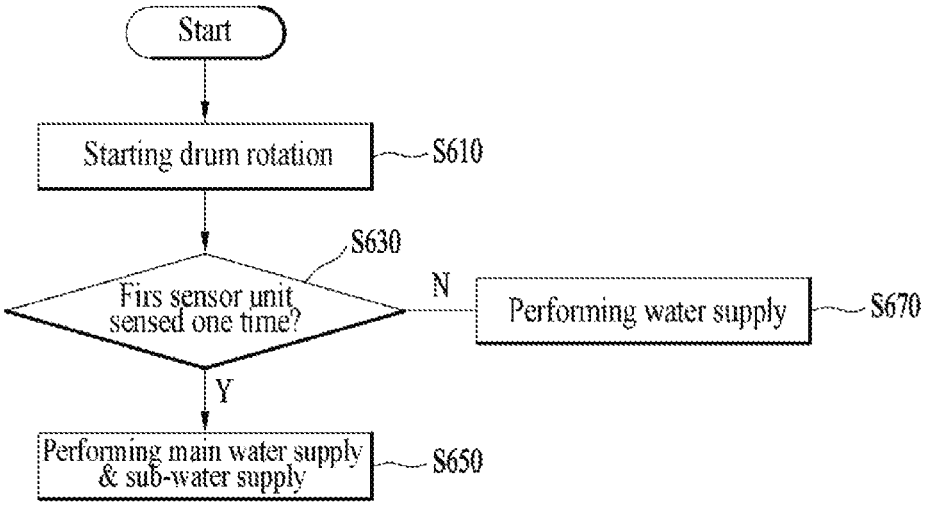
FIG. 7 is a flow chart illustrating a step for determining whether the sub-drum is mounted in the drum.

Referring to FIG. 7, the control method in accordance with one embodiment will be described in detail.

It has to be determined whether the washing course is performed only in the drum 30 or the sub-drum 50. For that, the drum is rotated (S610) and the drum is rotated to determine whether the sub-drum 50 is mounted or whether the sub-drum 50 is normally mounted. It can be said that such determination is performed to determine whether to supply wash water only to the drum 30 or both of the drum 30 and the sub-drum 50.

More specifically, the control unit 100 is implemented to control the drive unit 14 to rotate the drum 30. When the drum 30 is rotated, the second sensor unit 25 senses the rotation angle of the drum 30 and transmits a signal to the control unit 100.

Meanwhile, when a normal signal is not received from the first sensor unit, it may be determined that the sub-drum is not mounted or that the sub-drum is mounted abnormally. As one example, when receiving no signal from the first sensor unit 54 while the second sensor unit 24 senses that the rotation angle of the drum 30 is 360 degrees, the control unit 100 may determine that the sub-drum 50 is not mounted in the drum 30 (S630-N).

When determining that the sub-drum 50 is not mounted in the drum 30, the control unit 100 is implemented to control the water supply unit 18 to supply wash water to the drum 30 (S670). In this instance, the location control of the drum for the water supply may not be performed. In other words, the control unit 100 may not control the drive unit 18 and the brake unit 110 to locate the outer water supply guide 570 or the inner water supply guide 560 under the water supply unit.

When it is determined that the sub-drum 50 is mounted abnormally, an alarm may be provided.

Meanwhile, when a normal signal is received from the first sensor unit, it may be determined that the sub-drum is mounted normally. As one example, when receiving the signal from the first sensor unit 54 while the second sensor unit 25 senses that the rotation angle of the drum 30 is 360 degrees, the control unit 100 may determine that the sub-drum 50 is mounted in the drum 30 (S630-Y).

Once determining that the sub-drum 50 is mounted in the drum 30 normally, the control unit 100 is implemented to perform the location control of the sub-drum 50 so as to supply wash water.

As one example, the control unit performs a main water supply to the drum 30 by locating the outer water supply guide 570 under the water supply unit 18. The control unit 100 may perform a sub-water supply configured to rotate the sub-drum 50 a preset angle and then locate the main water supply and the inner water supply guide 560 under the water supply unit 18 (S650). Of course, the main-water supply may be performed after the sub-water supply.

Once the water supply starts, wash water is exhausted via the water supply unit 18. The exhausted wash water is supplied to the sub-drum 50 via the water supply guide 560 and to the drum 30, in other words, the tub 20 via the outer water supply guide 570. In other words, the water supply is performed after the angle control is performed configured to locate the inner water supply guide 560 and the outer water supply guide 570 under the water supply unit 18 by rotating the sub-drum 50.

For example, the control unit 100 may control the drive unit 14 to rotate the sub-drum 50 at a low rpm for the water supply. In this instance, the rpm is set as '3'. When the first sensor unit 54 transmits a sensing signal to the control unit 100, the control unit 100 may rotate the sub-drum 50 a preset angle from the moment when the first sensor unit 54 sends the sensing signal and locate the outer water supply guide 570 under the water supply unit 18. Such the rotation angle is preset according to the arrangement relation among the first sensor unit 54, the outer water supply guide 570 and the water supply unit 18.

The rotation angle of the sub-drum 50 is measured by the second sensor unit 25 and transmitted to the control unit 100, while the sub-drum 50 is rotated at a very low rpm. The control unit 100 controls the brake unit 110 to stop the sub-drum once determining that the measured rotation angle reaches a preset rotation angle.

As the rpm of the sub-drum 50 is very low, the distance of the sliding sub-drum 50 from the point when the brake unit 110 starts is so small to be ignored. When the sub-drum 50 is stopped by the brake unit 110, the outer water supply guide 570 is almost located under the water supply unit 18. Accordingly, the wash water exhausted from the water supply unit 18 may be supplied to the drum 50 via the outer water supply guide 570, without correcting the location of the sub-drum 50.

Meanwhile, as the rpm of the sub-drum 50 is very low, the control unit 100 may cut off the currents flowing to the drive unit from the point or in a preset time period when the first sensor unit 54 senses the location of the sub-drum 50. At this time, the sub-drum 50 may be by the inertia. However, the angle of the rotation caused by the inertia at the low rpm may be so small to be ignored or expected from the current cut-off point. The stopping location of the sub-drum may be expected at the current cut-off point based on the rpm and the location of the sub-drum at the sensing point of the first sensor unit. The location control of the sub-drum 50 may become simpler on the assumption that there is no big error of the expected location.

The braking caused by the rotation of the sub-drum 50 to supply wash water via the inner water supply guide 560 is equal to the braking caused by the rotation of the sub-drum 50 to supply wash water via the outer water supply guide 570 mentioned above, such that detailed description thereof can be omitted.

Meanwhile, as another example for the precise location control of the sub-drum 50, the control unit 100 may control the drive unit 14 to slidingly move the sub-drum 50 from the point when the brake is applied to the sub-drum by raising the rpm of the sub-drum 50. In this instance, the rpm may be set as '15~25' and the embodiments are not limited thereto.

In this embodiment, the rotation angle to locate the outer water supply guide 570 under the water supply unit 18 when the first sensor unit 54 transmits a sensing signal may be also preset according to the arrangement relation among the first sensor unit 54, the outer water supply guide 570 and the water supply unit 18. However, in the preset rotation angle of this embodiment may be set to be the same value with the preset rotation angle in the above-noted embodiment. Considering the sliding distance of the sub-drum, the preset rotation angle of this embodiment may be smaller than that of the above-noted embodiment.

Similar to the above-noted embodiment, the rotation angle of the sub-drum 50 is measured during the rotation of the sub-drum and the measured values may be transmitted to the control unit 100. Once determining that the measured rotation angle reaches a preset rotation angle, the control unit 100 controls the brake unit 110 to stop the sub-drum 50.

The sub-drum 50 has variable sliding angles at which the sub-drum 50 is sliding from the brake start point by the wash water held therein and the weight of the laundry. Especially, when the rpm is relatively high, such a sliding angle may be diversified. When the second sensor unit 25 measures the sliding angle of the sub-drum 50 and transmits the measured angle to the control unit 100, the control unit 100 corrects the preset rotation angle. For example, the control unit corrects the preset rotation angle to be smaller when the sliding angle of the sub-drum 50 is large enough for the outer water supply guide 570 to pass by the lower area of the water supply unit 18. In vice versa, the control unit 100 corrects the preset rotation angle value to be larger. At this time, the rpm is 15-25 rpm which are higher than 3 rpm and lower than 40-49 rpm in the conventional washing such that little load may be applied to the drive unit 14. Accordingly, the overload of the drive unit may be prevented and the precise location control of the sub-drum may be facilitated. In other words, after the correcting process is performed to prevent a deviation or an error, the location control of the sub-drum is performed and the precise location control of the sub-drum may be then performed.

Meanwhile, after water is supplied to the drum 30 and the sub-drum 50, the drive unit 14 is implemented to rotate the drum 30 and the sub-drum 50 and perform the washing process.

In case of washing the laundry loaded in the drum 30, washing may be performed through diverse drum drive motions. According to one embodiment of the present invention, a basket motion and a pulsator motion may be implemented to wash the laundry loaded in the drum 30. The basket motion is one motion implemented to rotate only the drum and the pulsator motion is one motion implemented to rotate only the pulsator so as to form water currents in the drum. Accordingly, the washing may be substantially performed in the pulsator motion. Of course, the washing may be performed even in combination of diverse motions as well as such the motions.

Control factors including a combination pattern of motions, a duration of a motion and RPM may be set different according to the selected course. Such control factors may be changed based on information about not only the course but also the options selected by the user. As one example, control factors in the substantially performed course may be changed according to option information such as a contamination level, a water temperature, a dry-spinning RPM, a rinsing frequency and a wash water level.

Accordingly, control factors for washing may be selectable by the user and the selection may be facilitated through diverse user interfaces that are provided in the control panel. The user interfaces may be configured to perform the washing for the drum 30.

However, when the sub-drum 50 is mounted in the drum 30 to perform washing, it is preferred that diverse washing courses are provided to perform washing for the sub-drum 50. As one example, a special course for lingerie or delicate clothing needs to be performed in the sub-drum 50 or another special course for cleaning tools with severe contamination needs to be performed in the sub-drum 50.

In the basket motion, the drum is rotated and thus the sub-drum 50 is also integrally rotated with the drum. Accordingly, it is possible to realize a plurality of courses for the sub-drum 50 by changing the duration or RPM of the basket motion.

In other words, it is possible to perform a specific course for the sub-drum simultaneously or combinedly together with a specific course for the drum. However, in this instance, it is not easy to further provide an auxiliary user interface in the control panel to select a course for the sub-drum or a corresponding option to the selected course.

Hereinafter, referring to FIGS. 8 through 10, various embodiments of a filter unit 90 and 90*a* will be described in detail.

Figure 8:
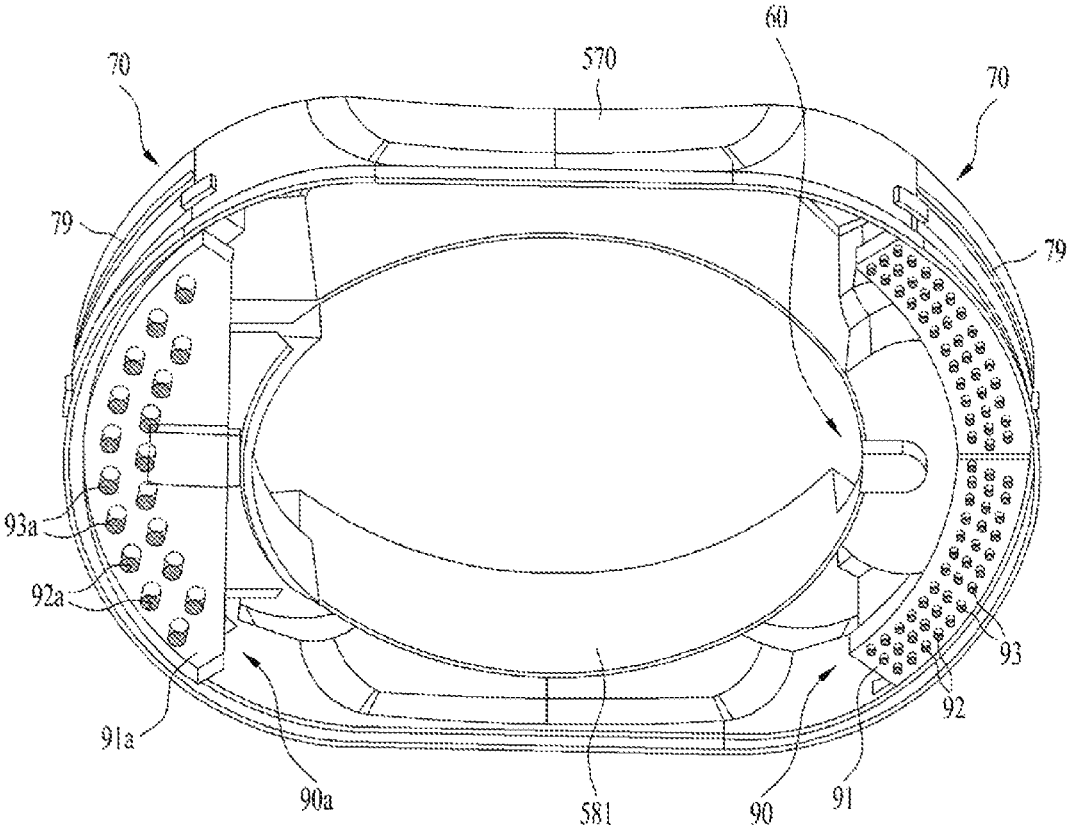
FIG. 8 is a perspective diagram illustrating various embodiments of a filter unit provided in a lower surface of a sub cover.

FIG. 8 is a perspective diagram illustrating various embodiments of the filter unit 90 and 90*a* provided in a lower surface of a sub cover. FIG. 9 is a sectional diagram illustrating the filter unit 90*a* illustrated in FIG. 8 and FIG. 10 is a sectional diagram illustrating another filter unit 90*a* illustrated in FIG. 8.

Figure 9:
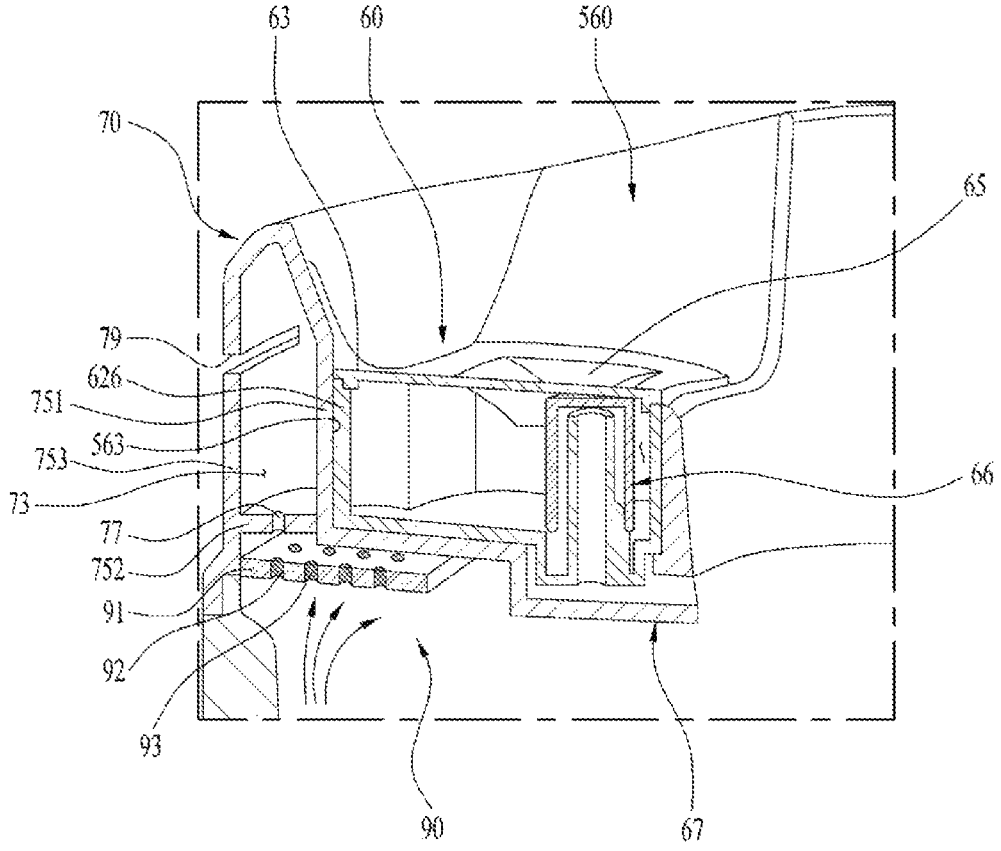
FIGS. 9 and 10 are sectional diagrams illustrating the filter units illustrated in FIG. 8.

Referring to FIGS. 8 and 9, the filter unit 90 according to one embodiment of the present invention is provided in a lower area of the discharging unit 70 and configured to filter the wash water raised by the centrifugal force generated by the rotation of the sub-drum 50.

Such the filter unit 90 may include a body 91 extended from a lateral wall of the sub-drum 50 towards the center of the sub-drum 50 and across the flow direction of the rising wash water; a through-hole 92 having the body 91; and a filter 93 provided in the through-hole 92 and configured to filter the wash water.

The body 91 is provided under the inlet hole 77 of the discharging area 70 and arranged to across the flow of the wash water rising along the inner circumferential surface of the sub-drum 50 while following an arrow.

The through-hole 92 is provided to penetrate the body 91. The plurality of the through-holes 92 may be provided in the body 91. The filter 93 may be provided in the through-hole 92 to filter the wash water penetrating the through-hole 92. Accordingly, the wash water rising along the arrow may be filtered by the filter 93, while penetrating the through-hole 92, and drawn into the discharging area 70 via the inlet hole 77.

Meanwhile, the body 91 may be extended from the lateral wall of the sub-drum 50 towards the center of the sub-drum 50. Moreover, the body 91 may be more extended towards the center of the sub-drum 50 than the inlet hole 77 of the discharging area 70.

The through-hole 92 may be smaller than the overall area of the body 91. When the rising wash water meets the body and is drawn into the through-hole 92, resistance occurs. When the resistance occurs, the wash water flows towards the center of the sub-drum 50 along a lower surface of the body 91.

In this instance, unless the body 91 is sufficiently extended towards the center of the sub-drum 50, the wash water flowing towards the center of the sub-drum 50 could be drawn into the inlet hole 77 over an inner end of the body 91, without passing through the filter 93. If the wash water not filtered by the filter 93 is drawn into the discharging area 70, the discharging area 70 might be clogged disadvantageously.

The through-holes 92 may be distributed in an entire area of the body 91. In other words, the through-holes 92 may be uniformly distributed from one end of the body 91 to the other end directed towards the center of the sub-drum 50.

The filter unit 90 may be provided in an upper end of the sub-drum 50 not only to filter the wash water rising along the inner circumferential surface of the sub-drum 50 but also to reduce the water currents affected by the filter unit 90 as much as possible. The water currents may be generated by the rotation of the sub-drum 50. The filter unit 90 provided in the upper end may prevent the capacity of the sub-drum 50 from being reduced by the filter unit 90 as much as possible.

Meanwhile, the sub-drum 50 may include a detergent box 60 as one example which is provided to accommodate a detergent and perform a function of discharging the detergent into the sub-drum. The detergent box 60 is supplied wash water from the water supply unit 18 to discharge the accommodated detergent and discharges the detergent together with the supplied wash water via a detergent discharging unit 66 using a siphon effect. A lower cap unit 67 may be projected from a lower surface of the detergent discharging area 66 to prevent the siphon effect generated by the rising wash water drawn into the detergent discharging unit 66.

The filter unit 90 has the other end of the body 91 extended to one side of the lower surface of the detergent box or the lower cap unit 67 to prevent the wash water from being drawn into the discharging area 70 over the other end of the body 91. The lower surface of the detergent box may be downwardly inclined towards the center of the sub-drum 50. Only the other end of the body 91 except the through-holes 92 can contact with the lower surface of the detergent box. Accordingly, the wash water penetrates the through-holes 92 smoothly and most of the wash water may be prevented from being drawn into the discharging area 70 over the other end of the body 91 even the rotation speed of the sub-drum 50 rises.

Figure 10:
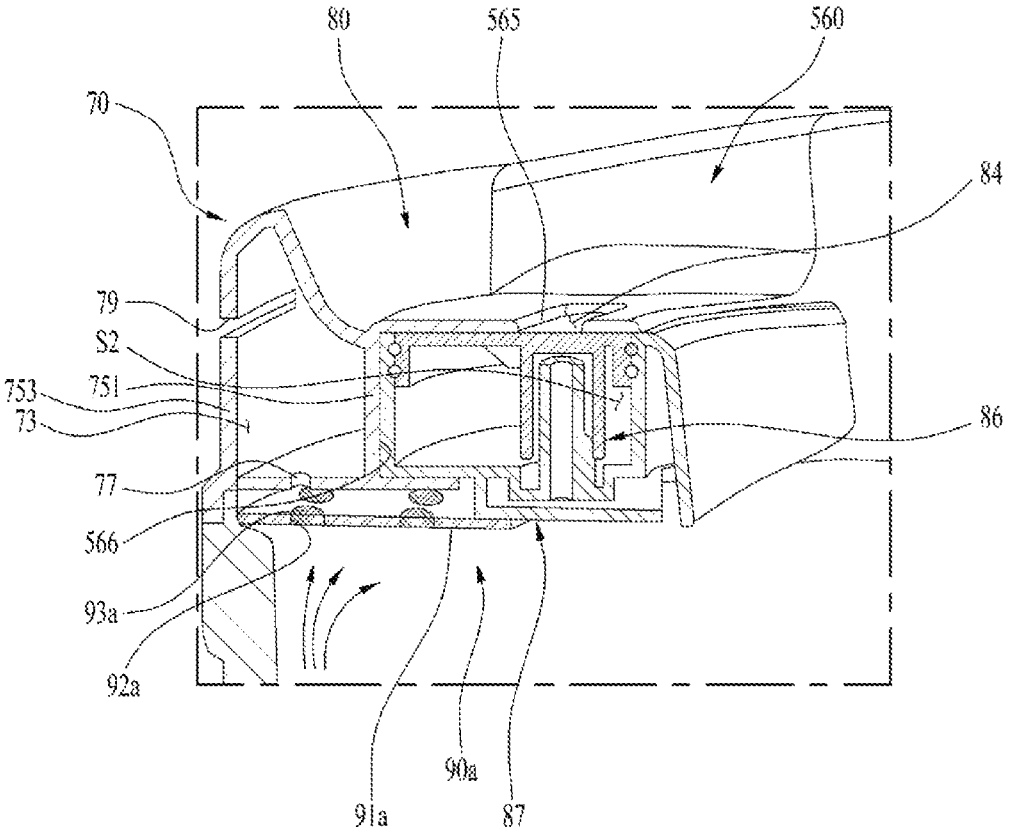

Meanwhile, referring to FIGS. 8 and 10, a detergent box 80 as another example may include a detergent discharging unit 86 configured to discharge detergent together with the wash water supplied from the water supply unit 18 into the sub-drum 50 by using a siphon effect; and a lower cap unit 87 configured to cover a lower end of the detergent discharging unit 86 not to expose the detergent discharging unit 86 to the inside of the sub-drum 50. Such the detergent box 80 may be kept in a maintenance groove 752 to allow the user to retract the detergent box 80 towards the center of the sub-drum 50 easily.

A filter unit 90*a* may be coupled to the retractable detergent box 80 from the sub-drum 50 to clean the foreign substances accommodating on the filter 91*a* provided in a through-hole 102. In this instance, the filter unit 91*a* may be coupled to a lower cap unit 87. The description of the filter unit 90*a* is equal to that of the above-noted filter unit 90, except the structure configured to couple the filter unit 90*a* to the lower surface of the detergent box 80, and is omitted to avoid repeated description accordingly, The filter unit 90*a* according to this embodiment may directly perform the filtering before wash water is drawn into the discharging area 70. The wash water having the filtering process may be discharged outside the sub-drum via the discharging area 70.

The wash water discharged via the discharging area 70 may flow along an inner surface of the tub from the upper area of the drum, without passing through the inside of the drum. Accordingly, when the discharging area 70 is clogged, it is concerned to interfere with the independent discharging of the wash water. As the wash water is filtered before being drawn into the discharging area 70, the clogging of the discharging area 70 may be effectively prevented. In other words, the independent wash water discharging of the discharging area 70 can be effectively maintained.

Figure 11:
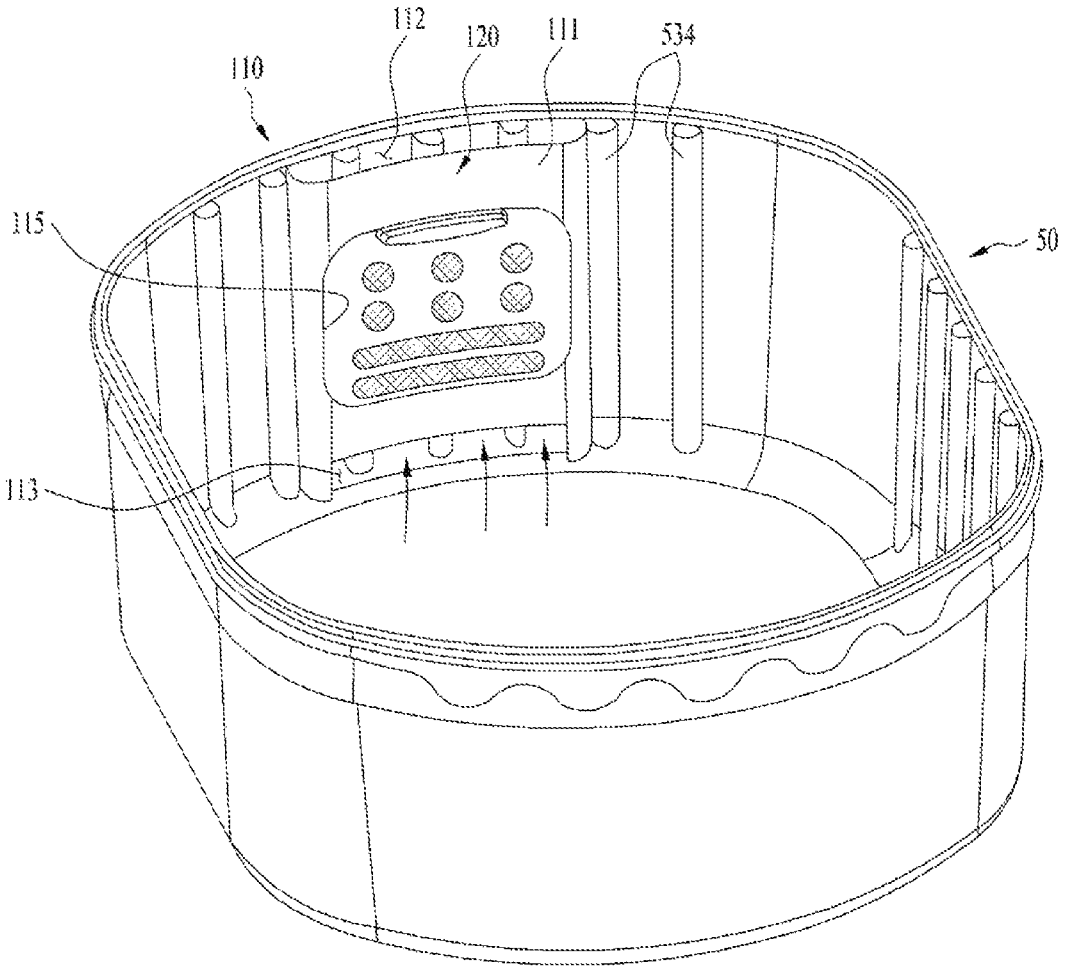
FIG. 11 is a perspective diagram illustrating a filter unit in accordance with another embodiment that is provided in an inner circumferential surface of the sub-drum.
Figure 12:
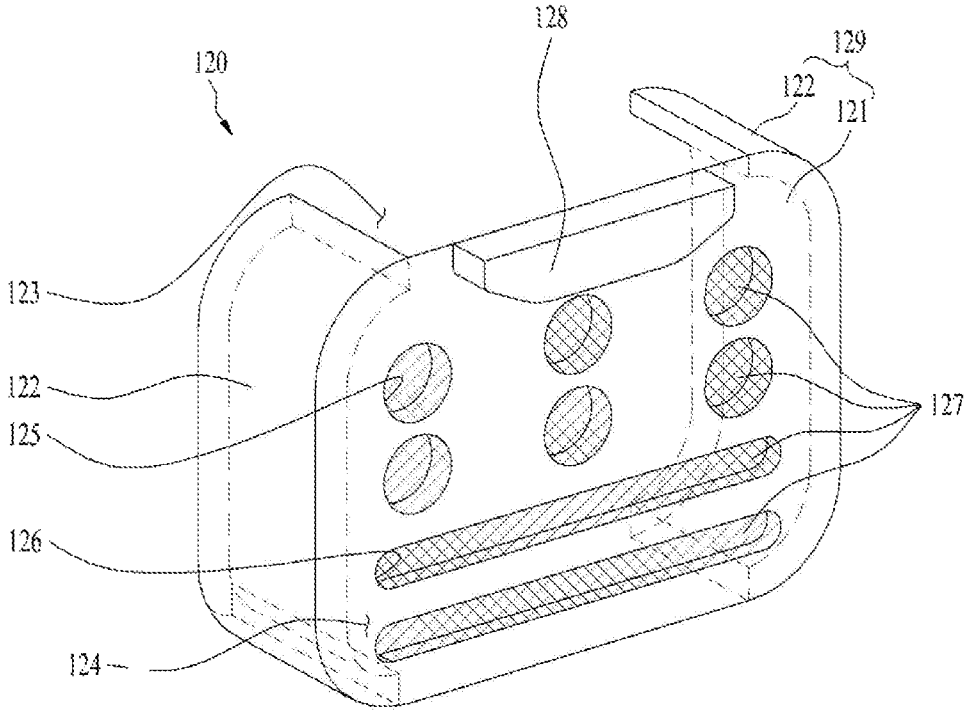
FIG. 12 is a perspective diagram illustrating the filter unit illustrated in the FIG. 11.

Referring to FIGS. 11 and 12, a filter unit 120 according to another embodiment will be described in detail. FIG. 11 is a perspective diagram illustrating the filter unit 120 in accordance with another embodiment that is provided in an inner circumferential surface of the sub-drum 50. FIG. 12 is a perspective diagram illustrating the filter unit 120 illustrated in the FIG. 11.

Referring to FIGS. 11 and 12, a path unit 110 configured to provide a flow path of the wash water raised by the centrifugal force of the rotating sub-drum 50 may be provided in the sub-drum 50. The filter unit 120 according to this embodiment is provided in the path unit 110 and configured to filter the wash water flowing along the path unit 110.

The path unit 110 includes a path body 111 having the flow path of the wash water provided therein; a lower opening 13 provided in a lower end to drawn the wash water from the sub-drum 50; an upper opening 112 provided in an upper end of the path body 111 and configured to discharge the drawn wash water; and a keeping area 115 provided to keep the filter unit 120 therein.

The path body 111 is provided in an inner circumferential surface of the sub-drum 50 and the flow path of the wash water is vertically extended in the path body 111 to be connected with the lower opening 113 and the upper opening 112.

The lower opening 113 is provided in a lower end of the path body 111 and facilitates communication between the inside of the sub-drum 50 and an accommodating space of the path body 111. The lower opening 113 is oriented towards the center of the sub-drum 50 to drawn the wash water flowing to the inner circumferential surface of the sub-drum into the path unit.

The upper opening 112 is provided in an upper end of the path body 111 and located higher than the keeping area 115 configured to keeping the filter unit 120 therein.

Meanwhile, the path body 111 is projected from the inner circumferential surface of the sub-drum 50. When the path body 111 is recessed from a lateral wall of the sub-drum 50, the lateral wall of the sub-drum is partially projected outwardly and it is then difficult to couple the lateral wall of the sub-drum 50 and the inner circumferential surface of the sub-drum 50 to each other. In addition, as the path body 111 is projected from the inner circumferential surface of the sub-drum 50, water currents may be formed in the sub-drum 50 by the rotation of the sub-drum 50 like a friction rib.

The filter unit 120 includes body 129 provided to accommodate wash water; an inlet hole 124 configured to drawn the wash water into the body 129 from the sub-drum 50; and a filter 127 configured to filter the wash water drawn into the body 129 and discharge the filtered water into the sub-drum 50.

The body 129 includes a front panel 121 oriented towards the inside of the sub-drum 50; and a flange projected towards the inner circumferential surface of the sub-drum 50 from the front panel 121 to facilitate the keeping process of the keeping area 115 provided in the path unit 110.

The inlet hole 124 is provided in a lower end of the flange 122 and the inlet hole 124 draws the wash water drawn into the path body 111 via the lower opening 113 of the path unit 110 into the body 129.

The front panel 121 is located higher than the inlet hole 124. A plurality of through-holes may penetrate the front panel 121 and a filter 127 is provided in each of the through-holes to filter the wash water.

The through holes may include an upper through-hole 125 located in an upper end of the front panel 121; and a lower through-hole located in a lower end of the front panel 121. The area of the upper through-hole 125 is narrower than that of the lower through-hole 126. When wash water is held in the body 129, a water pressure becomes lower towards the top and it is more advantageous in ejecting the wash water strongly as the area of the upper through-hole 125 is narrower.

An outlet hole 123 may be further provided in an upper end of the flange 122. The outlet hole 123 is provided higher than the front panel 122 and the wash water is discharged into the path body 111 from the body 129. Accordingly, the wash water may be prevented from being dispersed via the filter 127 by the raised water pressure in the body 129. Meanwhile, the outlet hole 123 is located lower than the upper opening 112. The water level raised even to the upper opening 112 as the water pressure rises in the body 129 gets lower and the wash water may be discharged accordingly, while filtered via the filter 127.

A handle 128 may be provided in the front panel 121 to facilitate the user to detach the filter unit 120 from the path unit 110.

Hereinafter, referring to FIGS. 11 and 12, the process of filtering the wash water by using the filter unit 120 according to another embodiment will be described.

Once the sub-drum 50 is rotated, the wash water held in the sub-drum 50 is moved towards the lateral wall of the sub-drum 50 by the centrifugal force of the rotating sub-drum 50.

The wash water moved to the lateral wall of the sub-drum 50 is drawn into the path body 111 via the lower opening 113.

The drawn wash water rises to be drawn into the body 129 of the filter unit 120 via the inlet hole 124 and the water is then filtered while passing the filter 127 provided in each of the through-holes.

At this time, when the centrifugal force increases, the water level in the body 129 rises. Some of the wash water rising in the body 129 may continuously rise, without being filtered, and it may be discharged via the upper opening 112.

Once the centrifugal force decreases, the water level falls in the path body 111 and some of the wash water located between the filter 127 and the upper opening 112 is discharged after passing through the filter 127.

Meanwhile, the path unit 110 having the filter unit 120 according to this embodiment insertedly coupled thereto may be provided in the sub-drum 50. In this instance, the path unit 110 having the filter unit 120 according to this embodiment insertedly coupled thereto may be provided under the filter unit 120 according to the above embodiment.

Accordingly, some of the wash water is filtered by the filter unit 120 according to another embodiment and some of the other wash water is filtered by the filter unit 120 according to the one embodiment described above during the wash or rinsing cycle configured to repeat the clockwise and counter-clockwise direction rotation at the washing rpm or rinsing rpm.

Moreover, the wash water is filtered by the filter unit 120 according to the embodiment described above during the dry-spinning cycle configured to rotate the sub-drum 50 in one direction at the dry-spinning rpm that is higher than the washing rpm or rinsing rpm. During the dry-spinning cycle, the centrifugal force becomes strong and it is difficult to discharge the wash water while filtering it via the filter 127 of the filter unit 120 according to the above embodiment.

Figure 13:
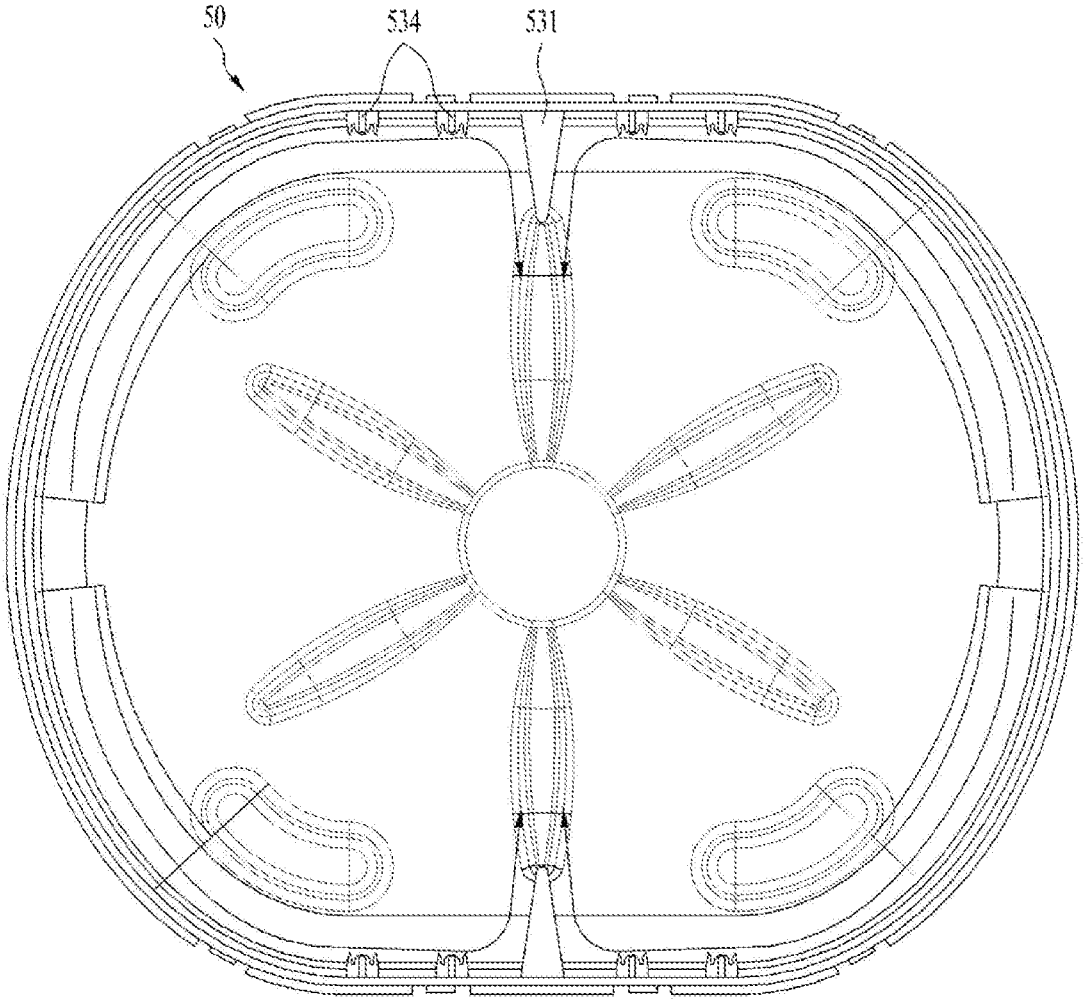
FIG. 13 is a plane view illustrating a filter unit in accordance with a further embodiment that is provided in the inner circumferential surface of the sub-drum.
Figure 14:
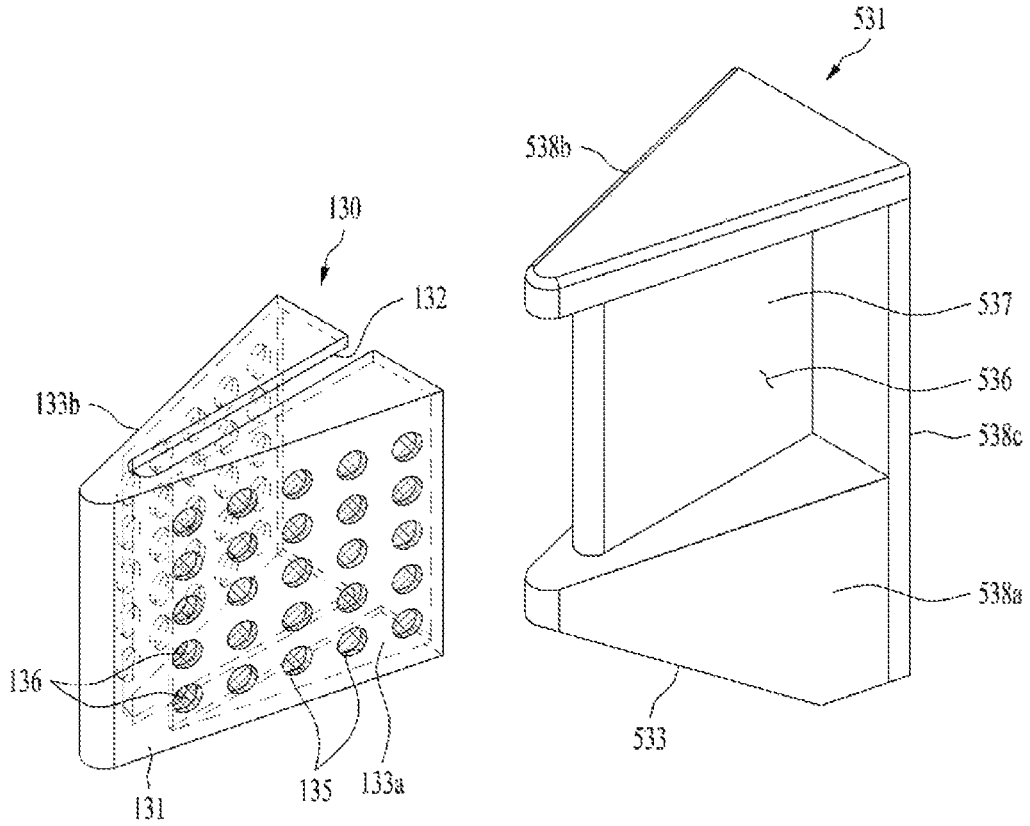
FIGS. 14 and 15 are perspective diagrams illustrating the filter unit illustrated in FIG. 13.
Figure 15:
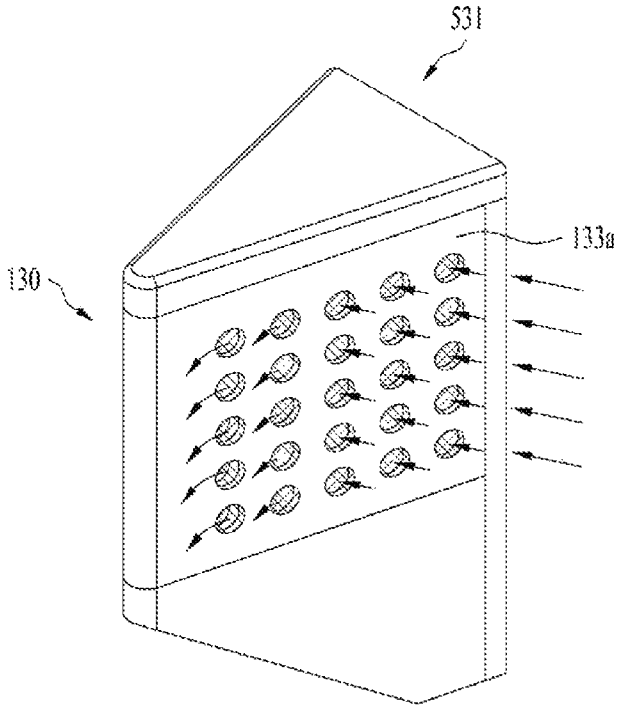

Hereinafter, referring to FIGS. 13 to 15, a filter unit 130 according to a further embodiment will be described. FIG. 13 is a plane view illustrating a filter unit 130 in accordance with a further embodiment that is provided in the inner circumferential surface of the sub-drum 50. FIGS. 14 and 15 are perspective diagrams illustrating the filter unit 130 illustrated in FIG. 13.

Referring to FIGS. 13 to 15, the filter unit 130 according to the further embodiment is provided in a guide rib 531 and configured to filter the wash water collided with the guide rib 531.

The filter unit 130 according to this embodiment includes a body 131 defining a space for accommodating wash water; a plurality of body communication holes 135 provided in the body 131 and configured to facilitate communication between the accommodating space and the inside of the sub-drum 50; and a filter 136 provided in each of the body communication holes 135 and configured to filter the wash water.

The sub-drum 50 repeats clockwise and counter-clockwise direction rotation during the wash or rinsing cycle. Accordingly, the water currents generated by the rotation of the sub-drum 50 is also alternately formed in the two directions along an arrow illustrated in FIG. 13. The wash water collides with one surface and the other surface of the guide rib 531 along the water currents. The surface and the other surface of the guide rib 531 may be provided in the filter unit 130 to across the water currents.

To allow the filter unit 130 to filter the wash water whenever the two direction water currents are alternately formed, the body 131 is formed to surround the guide rib 531. Accordingly, the wash water filtered while penetrating some of the body communication holes 135 may be drawn into the body 131. The wash water is discharged towards the other body communication holes 135 after being drawn into the body 131.

Meanwhile, the water currents generated by the rotation of the sub-drum 50 occur due to the frictional force with the sub-drum 50. The rotation speed rises higher and higher as getting towards the lateral wall of the sub-drum 50 from the center of the sub-drum 50. The plurality of the communication holes 135 provided in the body 131 may be collided with fast water currents as getting closer to the lateral wall of the sub-drum 50 only to receive a higher water pressure as getting closer to the lateral wall of the sub-drum 50. Accordingly, the wash water is drawn into the body 131 via some body communication holes 135 close to the lateral wall of the sub-drum 50 and discharged from the body 131 via some of the other body communication holes 135 farther from the lateral wall of the sub-drum 50.

Meanwhile, the wash water is firstly filled in a space closer to the lateral wall of the sub-drum 50 among the accommodating space formed in the body 131. That is because a higher water pressure is actuated to the closer ones of the body communication holes 135 to the lateral wall of the sub-drum 50. In this instance, the space firstly filled with the wash water is functioned as the resistance that interferes with the drawing of the wash water. Accordingly, when the wash water penetrates the closer one of the body communication holes 135 to the lateral wall of the sub-drum 50, a strong resistance could be applied to the wash water and it may be difficult to draw and discharge the wash water into and from the filter unit 130.

In this instance, the filter unit 130 according to this embodiment may be formed to enlarge the accommodating space of the body 131 as getting closer to the lateral wall of the sub-drum 50. Accordingly, the point at which the above-noted resistance is generated may be delayed and the wash water can penetrate the closer ones of the body communication holes 135 to the lateral wall of the sub-drum 50 smoothly until the delayed point of time at which the resistance is generated. Here, the point of time at which the resistance is generated may be the time period from the point when the rotational direction of the sub-drum 50 rotated in the clockwise or counter-clockwise direction is changed to the point when the closest space to the lateral wall of the sub-drum 50 is firstly filled with wash water in the accommodating space of the body 131 before the rotation direction is changed again.

When the body 131 is designed to occupy a predetermined space of the sub-drum 50 to secure a sufficient capacity of the sub-drum 50, it is advantageous to the accommodating space for the body 131 is formed to enlarge towards the lateral wall of the sub-drum 50.

Such the body 131 may include a pair of body inclined surfaces 133*a* and 133*b* formed to across the water currents, similar to the guide rib 531. The body inclined surfaces 133*a* and 133*b* is collided with one water current actuated in the clockwise direction and another water current actuated in the counter-clockwise direction, respectively, as shown in FIG. 13. The body communication holes 135 may be provided in the pair of the inclined surfaces 133*a* and 133*b*.

The pair of the body inclined surfaces 133*a* and 133*b* may form a preset angle with respect to the direction of the water currents. A cross section area of the body may be formed in a triangle shape which has an enlarging width towards the lateral wall of the sub-drum 50, A keeping area is recessed from one side of the guide rib 531 to keep the filter unit 130 therein. A coupling rib 537 may be vertically extended from the keeping area to couple the filter unit 130 kept in the keeping area. A coupling groove 132 is formed in the body 131 to having the coupling rib 537 inserted therein.

The coupling rib 537 may partition off the body 131 into two areas to prevent the wash water having passed one of the body inclined surfaces 133*a* from being discharged after passing the other one. Accordingly, the wash water is drawn into and discharged from one body inclined surface 133*a*. If the wash water having passed one of the body inclined surfaces 133*a* passes the other one 133*b*, the foreign substances accumulating on an outer surface of the filter 136 provided in the other body inclined surface 133*b* might fall off into the sub-drum 50.

The guide rib 531 includes rib inclined surfaces 538*a* and 538*b* provided in one surface provided to across the direction of the water currents and the other opposite surface, respectively. Moreover, a cross section area of the guide rib 531 may be formed in a triangle shape that has an enlarging width towards the lateral surface of the sub-drum 50. Accordingly, in a state where a level of the rotating wash water is not raised, the wash water may be guided to the filter unit 130 by the rib inclined surfaces 538*a* and 538*b* effectively. In addition, the body inclined surface 133*a* and 133*b* and the rib inclined surfaces 538*a* and 538*b* may form the same surface so as to guide the wash water smoothly.

Hereinafter, referring to FIGS. 13 to 15, the process of filtering the wash water by using the filter unit 130 according to the further embodiment will be described.

When the sub-drum 50 repeats the clockwise and counter-clockwise direction rotation, the water currents generated by the rotation of the sub-drum 50 is repeatedly formed in the two directions along an arrow.

When the sub-drum 50 is rotated in the clockwise direction, the wash water is also rotated in the same direction.

As the centrifugal force becomes increased, the wash water is rotated as gradually rising along the lateral surface of the sub-drum 50. The rotation of the wash water is generated by the friction against the lateral wall of the sub-drum 50 and the rotation speed of the wash water rises as getting closer to the lateral wall of the sub-drum 50.

Once the wash water is collided with the body inclined surfaces 133*a* and 133*b* of the filter unit 130, the wash water is drawn into the body 131 via the closer one of the body communication holes 135 to the lateral surface of the sub-drum 50 and the drawn wash water is discharged via the farther distant one of the body communication holes 135. That is because water pressures are different according to different rotation speeds of the wash water. The filter units 90, 90*a*, 120 and 130 according to the embodiments described above may be combineldy realized.

The filter units 90 and 90*a* may filter the wash water before the wash water is discharged. Accordingly, the filtering is substantially performed during the drainage process of the dry-spinning cycle.

The filter units 120 and 130 may be provided in the inner lateral wall of the sub-drum 50 and filter the wash water during the washing cycle. Accordingly, the plurality of the filter units may be provided in different positions.

Meanwhile, the filters may be detachably provided in the sub-drum and it is easy to clean the filters accordingly.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

INDUSTRIAL APPLICABILITY

Industrial applicability of aspects of the present disclosure is included in the description of the specific embodiments.

What is claimed is:

1. A laundry treating apparatus comprising:

a tub configured to hold wash water;

a drum rotatably supported in the tub, the drum comprising a shaft disposed perpendicular with the ground;

a sub-drum detachably mounted to an inner circumferential surface of the drum and configured to wash laundry independently from the drum;

a discharging area spaced apart from an outer lateral wall of the sub-drum by a preset distance in an inner radial direction to form a chamber in which washing water is temporarily stored, the discharging area comprising an inlet hole provided in a bottom surface of the chamber and configured to draw wash water of the sub-drum to the chamber by a centrifugal force generated by the rotation of the sub-drum, and an outlet hole provided in a side surface of the chamber and configured to discharge wash water of the chamber to outside of the sub-drum by a centrifugal force generated by the rotation of the sub-drum; and a filter unit disposed under the discharging area, the filter unit being configured to filter the wash water drawn to the inlet hole by rotation of the sub-drum, wherein the filter unit comprises:

a body that extends towards a center of the sub-drum from the outer lateral wall of the sub-drum and crosses a flow direction of the rising wash water drawn into the discharging area;

a through-hole penetrating the body; and a filter disposed in the through-hole and configured to filter the wash water passing upwardly through the through-hole.

2. The laundry treating apparatus according to claim 1, wherein the filter unit is disposed under the inlet hole, and the wash water is raised and drawn into the discharging area of the sub-drum through the filter unit and through the inlet hole by a centrifugal force generated by the rotation of the sub-drum.

3. The laundry treating apparatus according to claim 1, wherein the filter unit is disposed in an upper end of the sub-drum and configured to filter wash water rising along an inner circumferential surface of the sub-drum.

4. The laundry treating apparatus according to claim 1, wherein the filter unit extends more from the outer lateral wall of the sub-drum towards the center of the sub-drum than the filter unit extends below the discharging area.

5. The laundry treating apparatus according to claim 1, wherein a cross-section of the drum is circular, and wherein the sub-drum comprises:

one or more coupling areas configured to be coupled to the inner circumferential surface of the drum; and one or more spaced areas alternately disposed with respect to the one or more coupling areas along a circumference of an upper end of the sub-drum and spaced a preset distance apart from the inner circumferential surface of the drum.

6. The laundry treating apparatus according to claim 5, wherein the filter unit is disposed adjacent to the one or more coupling areas.

7. A laundry treating apparatus comprising:

a tub configured to hold wash water;

a drum rotatably supported in the tub, the drum comprising a shaft disposed perpendicular with the ground;

a sub-drum detachably mounted to an inner circumferential surface of the drum and configured to wash laundry independently from the drum;

a detergent box disposed in the sub-drum and configured to accommodate a washing detergent, wherein the detergent box is retractable towards a center of the sub-drum; and a filter unit provided under the detergent box and configured to filter wash water moved upwardly by the rotation of the sub-drum and passing therethrough, wherein the filter unit comprises:

a body that extends towards a center of the sub-drum from the lateral wall of the sub-drum and crosses a flow direction of rising wash water;

a through-hole penetrating the body; and a filter disposed in the through-hole and configured to filter wash water passing upwardly through the through-hole, and wherein the filter unit is fixed to the detergent box and the filter unit and the detergent box are retractable with respect to the sub-drum.

* * * * *